US009683753B2

(12) United States Patent
Lorenz et al.

(10) Patent No.: US 9,683,753 B2
(45) **Date of Patent: *Jun. 20, 2017**

(54) FACILITATING INSTALLATION OF A CONTROLLER AND/OR MAINTENANCE OF A CLIMATE CONTROL SYSTEM

(71) Applicant: Emerson Electric Co., St. Louis, MO (US)

(72) Inventors: Thomas B. Lorenz, St. Louis, MO (US); Erik O. Rylski, Clayton, MO (US); Dennis Snow, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 551 days.

This patent is subject to a terminal disclaimer.

(21) Appl. No.: 14/280,103

(22) Filed: May 16, 2014

(65) Prior Publication Data

US 2014/0350733 A1 Nov. 27, 2014

Related U.S. Application Data

(60) Provisional application No. 61/827,517, filed on May 24, 2013, provisional application No. 61/843,508, (Continued)

(51) Int. Cl.
*G05D 9/00* (2006.01)
*F24F 11/00* (2006.01)

(52) U.S. Cl.
CPC ..... *F24F 11/0009* (2013.01); *F24F 2221/32* (2013.01)

(58) Field of Classification Search
None
See application file for complete search history.

(56) References Cited

U.S. PATENT DOCUMENTS 6,598,056 B1 7/2003 Hull et al.
7,397,369 B2 7/2008 Zajac et al.
(Continued)

FOREIGN PATENT DOCUMENTS

EP 1 587 292 7/2011
WO WO2004/044753 5/2004

OTHER PUBLICATIONS

*FTC Sensors, LLC* v. *Emerson Electric Co.* Complaint, Eastern District of Texas, Case 2:15-cv-02012 filed Nov. 30, 2015; 11 pages.
(Continued)

*Primary Examiner* — Philip Wang
(74) *Attorney, Agent, or Firm* — Harness, Dickey & Pierce, P.L.C.

(57) ABSTRACT

Disclosed are exemplary embodiments of apparatus and methods for facilitating installation and/or connection of controllers such as thermostats. In an exemplary embodiment, an apparatus for facilitating installation and/or connection of a controller in a climate control system generally includes a communication device configured to execute software instructions to receive user input describing a wire arrangement where the controller is to be installed for use in the climate control system. Based on the user input, the communication device identifies a configuration of the climate control system and specifies wiring connections between the wire arrangement and controller.

22 Claims, 17 Drawing Sheets

Related U.S. Application Data filed on Jul. 8, 2013, provisional application No. 61/929,433, filed on Jan. 20, 2014.

(56) References Cited

U.S. PATENT DOCUMENTS

| | | | | |
|---|---|---|---|---|
| 7,434,742 | B2 | 10/2008 | Mueller et al. | |
| 7,693,582 | B2 | 4/2010 | Bergman et al. | |
| 7,696,870 | B2 | 4/2010 | Zajac et al. | |
| 7,861,941 | B2 | 1/2011 | Schultz et al. | |
| 8,091,795 | B1 | 1/2012 | McLellan et al. | |
| 8,239,067 | B2 | 8/2012 | Amundson et al. | |
| D677,180 | S | 3/2013 | Plitkins et al. | |
| 8,421,621 | B2 | 4/2013 | Zajac et al. | |
| 8,442,693 | B2 | 5/2013 | Mirza et al. | |
| D687,043 | S | 7/2013 | Matas et al. | |
| D687,044 | S | 7/2013 | Ruff | |
| D687,045 | S | 7/2013 | Plitkins et al. | |
| D687,046 | S | 7/2013 | Plitkins et al. | |
| D687,047 | S | 7/2013 | Hales, IV et al. | |
| D687,050 | S | 7/2013 | Matas et al. | |
| D687,056 | S | 7/2013 | Matas et al. | |
| D687,057 | S | 7/2013 | Plitkins | |
| D687,058 | S | 7/2013 | Corcoran et al. | |
| D687,059 | S | 7/2013 | Bruck et al. | |
| D687,459 | S | 8/2013 | Sloo et al. | |
| D687,851 | S | 8/2013 | Sloo et al. | |
| D690,322 | S | 9/2013 | Matas et al. | |
| 8,523,083 | B2 * | 9/2013 | Warren | F24F 11/0012 200/50.08 |
| D691,629 | S | 10/2013 | Matas et al. | |
| D696,677 | S | 12/2013 | Corcoran et al. | |
| D697,526 | S | 1/2014 | Bruck et al. | |
| 2007/0114295 | A1 | 5/2007 | Jenkins | |
| 2008/0256475 | A1 | 10/2008 | Amundson et al. | |
| 2009/0254971 | A1 | 10/2009 | Herz et al. | |
| 2010/0063644 | A1 | 3/2010 | Kansal et al. | |
| 2010/0083356 | A1 | 4/2010 | Steckley et al. | |
| 2010/0146466 | A1 * | 6/2010 | Hadley | G06F 17/5095 716/111 |
| 2011/0061014 | A1 | 3/2011 | Frader-Thompson et al. | |
| 2011/0063126 | A1 | 3/2011 | Kennedy et al. | |
| 2012/0022701 | A1 | 1/2012 | Amundson et al. | |
| 2012/0065783 | A1 | 3/2012 | Fadell et al. | |
| 2012/0069131 | A1 | 3/2012 | Abelow | |
| 2012/0239203 | A1 * | 9/2012 | Amundson | G05B 19/0426 700/276 |
| 2012/0253520 | A1 * | 10/2012 | Sartain | F24F 11/0012 700/276 |
| 2013/0030589 | A1 | 1/2013 | Pessina et al. | |
| 2013/0060385 | A1 | 3/2013 | Leen et al. | |
| 2013/0095459 | A1 | 4/2013 | Tran | |
| 2013/0097664 | A1 | 4/2013 | Herz et al. | |
| 2013/0099011 | A1 | 4/2013 | Matsuoka et al. | |
| 2013/0103622 | A1 | 4/2013 | Matsuoka et al. | |
| 2013/0204440 | A1 * | 8/2013 | Fadell | F24F 11/0086 700/276 |
| 2013/0325997 | A1 | 12/2013 | Higgins et al. | |

OTHER PUBLICATIONS

Nest Community; www.communicaty.nest.com; 2013; 4 pgs.
ComfortTech 2013; www.comfortechshow.com; Sep. 18-20, 2013; 2 pgs.
http://www.lowes.com/cd_What+Is+Iris_695688710_; Iris Home Monitoring System; accessed Jan. 29, 2014; 2 pgs.

* cited by examiner

232

234

238

236

242

240

FACILITATING INSTALLATION OF A CONTROLLER AND/OR MAINTENANCE OF A CLIMATE CONTROL SYSTEM

CROSS-REFERENCE TO RELATED APPLICATIONS

This application claims the benefit of U.S. Provisional Application No. 61/827,517 filed May 24, 2013, U.S. Provisional Application No. 61/843,508 filed Jul. 8, 2013, and U.S. Provisional Application No. 61/929,433 filed Jan. 20, 2014. The entire disclosures of the above applications are incorporated herein by reference.

FIELD

The present disclosure generally relates to climate control systems and controllers, and more particularly (but not exclusively) to apparatus and methods for facilitating installation of controllers and maintenance of climate control systems.

BACKGROUND

This section provides background information related to the present disclosure which is not necessarily prior art.

When a new or replacement thermostat is installed for use in a climate control system, an installer connects wiring of the thermostat with wiring of the climate control system. A wide variety of thermostats are available, some of which are capable of wireless communication with a user's computer network.

SUMMARY

This section provides a general summary of the disclosure, and is not a comprehensive disclosure of its full scope or all of its features.

According to various aspects, exemplary embodiments are disclosed of apparatus and methods for facilitating installation and/or connection of a controller in a climate control system. In an exemplary embodiment, an apparatus for facilitating installation and/or connection of a controller in a climate control system generally includes a communication device having a processor and memory configured to execute instructions to: receive user input describing a wire arrangement where the controller is to be installed for use in the climate control system; and based on the user input, identify a configuration of the climate control system and specify wiring connections between the wire arrangement and the controller.

Also disclosed is an example system-performed method of facilitating installation and/or connection of a controller in a climate control system. The method generally includes providing computer-executable instructions to a communication device, the communication device having a processor and memory. The providing is performed to configure the communication device to: receive user input describing a wire arrangement where the controller is to be installed for use in the climate control system; and based on the user input, identify a configuration of the climate control system and specify wiring connections between the wire arrangement and the controller.

Also disclosed is an exemplary embodiment of a method of facilitating installation and/or connection of a controller in a climate control system. The method is performed by a communication device. The method generally includes instructing a user how to expose a wire arrangement where the controller is to be installed for use in the climate control system; receiving user input indicating how the wire arrangement is connected with an existing controller; based on the user input, determining a configuration of the climate control system and how to connect the wire arrangement with the controller to be installed; and based on the determining, connecting with and configuring the controller for the determined configuration of the climate control system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
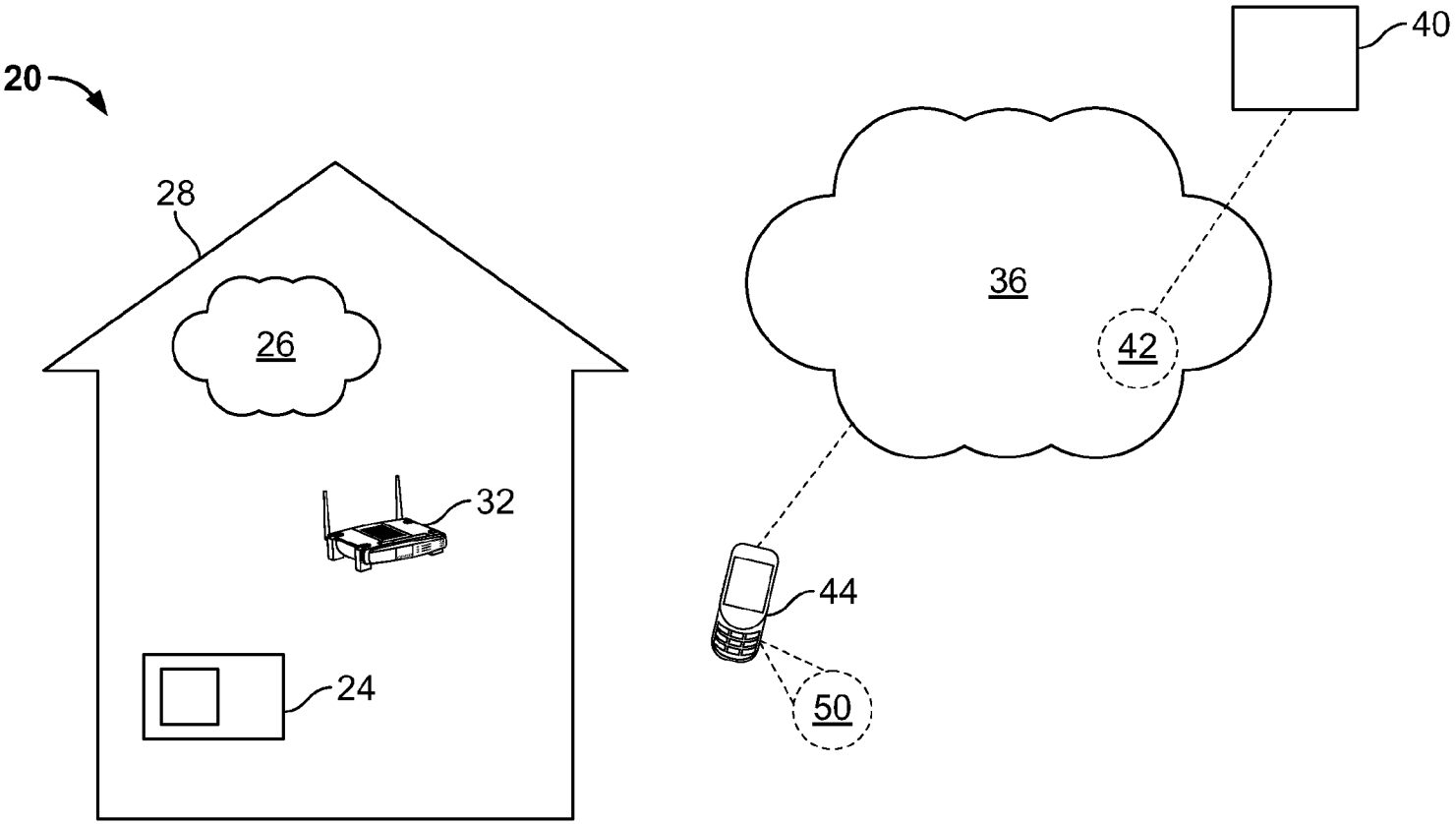
FIG. 1 is a diagram of an apparatus for facilitating installation and/or connection of a thermostat or other controller in accordance with an example embodiment.

Example embodiments will now be described more fully with reference to the accompanying drawings.

The inventors hereof have recognized that successful thermostat installation requires safe and correct wiring, and that a thermostat needs to be configured properly to operate with HVAC equipment. Further, where a thermostat is capable of wireless communication, it may be desirable to provision the thermostat to a wireless network so that, e.g., the thermostat may be remotely controlled by a user and/or associated with a user account, e.g., for provision of energy management services by an energy management services provider. The inventors also have recognized that replacing an existing thermostat can be challenging even for experienced HVAC installers because of the wide variety of thermostat models coupled with a lack of an effective standard for thermostat terminal identification. Consumers, and even installers with advanced HVAC training and years of experience, frequently make costly mistakes when they have trouble finding, deciphering, and implementing the operations or actions needed for correct installation. Even where a thermostat is wired correctly, many installers are unable to identify, understand, and implement the proper thermostat configuration. This can lead to high utility bills, service callbacks, and lost productivity for installers.

Accordingly, the inventors have developed and disclose herein exemplary embodiments of apparatus and methods for installing HVAC system thermostats and other controllers. In some embodiments, a software application ("app") can be downloaded to a smart phone, tablet, or other communication device whereby a user can be "walked through" steps for installation and provisioning for a thermostat. In various embodiments, the application provides the user with information relevant to and focused on the specific task currently at hand in the installation and provisioning process. Generally, aspects of the present disclosure relate to moving a relatively difficult or complicated configuration/setup process to an external computer device, providing easy and multi-media step-by-step support, and making the process interactive and adaptive between that external interface and the device being configured/set up (e.g., the thermostat itself.)

Exemplary embodiments are disclosed of an application that receives user input describing terminals used in an old thermostat to connect the old thermostat with climate control system wiring. In various embodiments, the application cross-references the terminals used in the old thermostat appropriately to terminals of a replacement thermostat. In some embodiments and based at least in part on the wires corresponding to the new thermostat terminals, the application may accurately determine the proper configuration option for the new thermostat. The application may send appropriate configuration parameters to the new thermostat, e.g., so that an installer or other user may configure appropriate operational parameters for the thermostat. Further, although various embodiments of the disclosure are described in relation to thermostats, the disclosure is not so limited. Other or additional types of controllers could be installed, wired and/or configured in accordance with various embodiments of the disclosure.

In some aspects of the disclosure, an apparatus is provided for guiding a homeowner, contractor or other user through a process of installing a thermostat. The user may be guided through the installation process from beginning to completion. In some embodiments, as part of the process, the apparatus automatically configures the thermostat for the climate control system into which the thermostat is being integrated. For example, a replacement thermostat may be automatically configured based on input from the user, who has observed the wiring and terminal designations on a thermostat being replaced. In various embodiments, a series of display screens may be provided on the user's smart phone or other communication device. One or more of the screens may visually and/or textually provide user instructions for a given stage of an installation process. When, e.g., a given installation stage is complete, the user may cause a following screen to be displayed for the next installation stage. The user may complete instructions related to the next stage, and so on, e.g., until thermostat installation is complete. It should be noted generally that although various embodiments of the disclosure are discussed with reference to display screens and visual cues, information may be communicated aurally (e.g., via sound, audio, etc.), tactilely, and/or visually in various embodiments.

With reference now to the figures, FIG. 1 illustrates an exemplary embodiment of an apparatus 20 for facilitating installation and/or connection of a thermostat or other controller embodying one or more aspects of the present disclosure. A thermostat 24 is provided for use in a structure 28, e.g., a residence, to control a climate control system of the structure 28. The thermostat 24 can be provisioned to communicate wirelessly in a user network 26 via a user network access point, e.g., a home network router 32 that provides wireless access to a wide-area network 36 such as the Internet and/or cellular network(s). In one example implementation a user, e.g., an owner or resident of the structure 28, obtains the wireless-communication-enabled thermostat 24, manufactured, e.g., by Emerson Electric Co. of St. Louis, Mo. In various embodiments, the thermostat 24 includes hardware, e.g., available from Qualcomm Incorporated, configured to enable the thermostat 24 to enter a "soft access point" ("soft AP") mode in which the thermostat 24 can perform at least temporarily as an access point in a wireless network.

As shown in FIG. 1, the apparatus 20 includes at least one computer 40, e.g., one or more servers, routers, personal computers, combinations of the foregoing, various combinations of processors and memory, etc. It should be noted that many different device configurations could be used to provide the capabilities described herein. In one example implementation, the computer(s) 40 are configured to provide energy information and energy management services through a web portal 42 available via the wide-area network 36. The web portal 42 may make such information and services available, e.g., to thermostat owners, installers, and other users. When, e.g., the thermostat 24 has been installed, a user may remotely access the thermostat 24, e.g., from a user communication device 44, which may be, e.g., a smartphone, an Internet-accessible laptop or desktop computer, a tablet, or other device.

As further described below, a user who is, e.g., an owner and/or an installer may utilize a user communication device 44 to facilitate installation of the thermostat 24 in the structure 28 and/or to facilitate provisioning of the thermostat 24 to the home network router 32. Other or additional types of devices may be used if configurable in accordance with one or more embodiments of the present disclosure. A user communication device 44 may include (without limitation) a mobile device such as a cellular or mobile phone, a smart phone such as a Blackberry®, an Android® device, an I-Phone® or I-Pad®, that can communicate using wireless communication, including but not limited to Wi-Fi, 802.11-based, WiMAX, Bluetooth, Zigbee, 3G, 4G, subscriber-based wireless, PCS, EDGE, and/or other wireless communication means, or substantially any combination thereof. The user communication device 44 has, or has access to, a software application 50 configured to perform various functions in accordance with various implementations of the disclosure. It should be noted generally that the term "software application" is to be interpreted broadly in the present disclosure. A "software application" can take many forms, including but not limited to source, object, and/or executable codes that can include and/or refer to a plurality of objects, modules, libraries, services, etc., and that can be stored, distributed, downloaded, combined and/or accessed in many different ways. In one example implementation, the software application 50 is loaded onto the communication device 44 by the computer(s) 40. The software application 50 may be written, e.g., in C++, development systems for Apple iOS, Android, etc. Implementations also are possible in which the user communication device 44 uses and/or communicates through web services and/or a web browser to implement the application 50. In some implementations the application 50, and/or execution of the application 50, may be distributed, e.g., among two or more computers located, e.g., in two or more geographic locations. In some embodiments the user communication device 44 may receive user input and send the input, e.g., to a server that has or has access to the application 50. The server may be included, e.g., in computer(s) 40 and may cause at least a portion of the application 50 to be executed to produce output, which may be sent, e.g., by the server to the user communication device 44. Additionally or alternatively, a user may access the application 50 via a browser of the user communication device 44.

Figure 2:
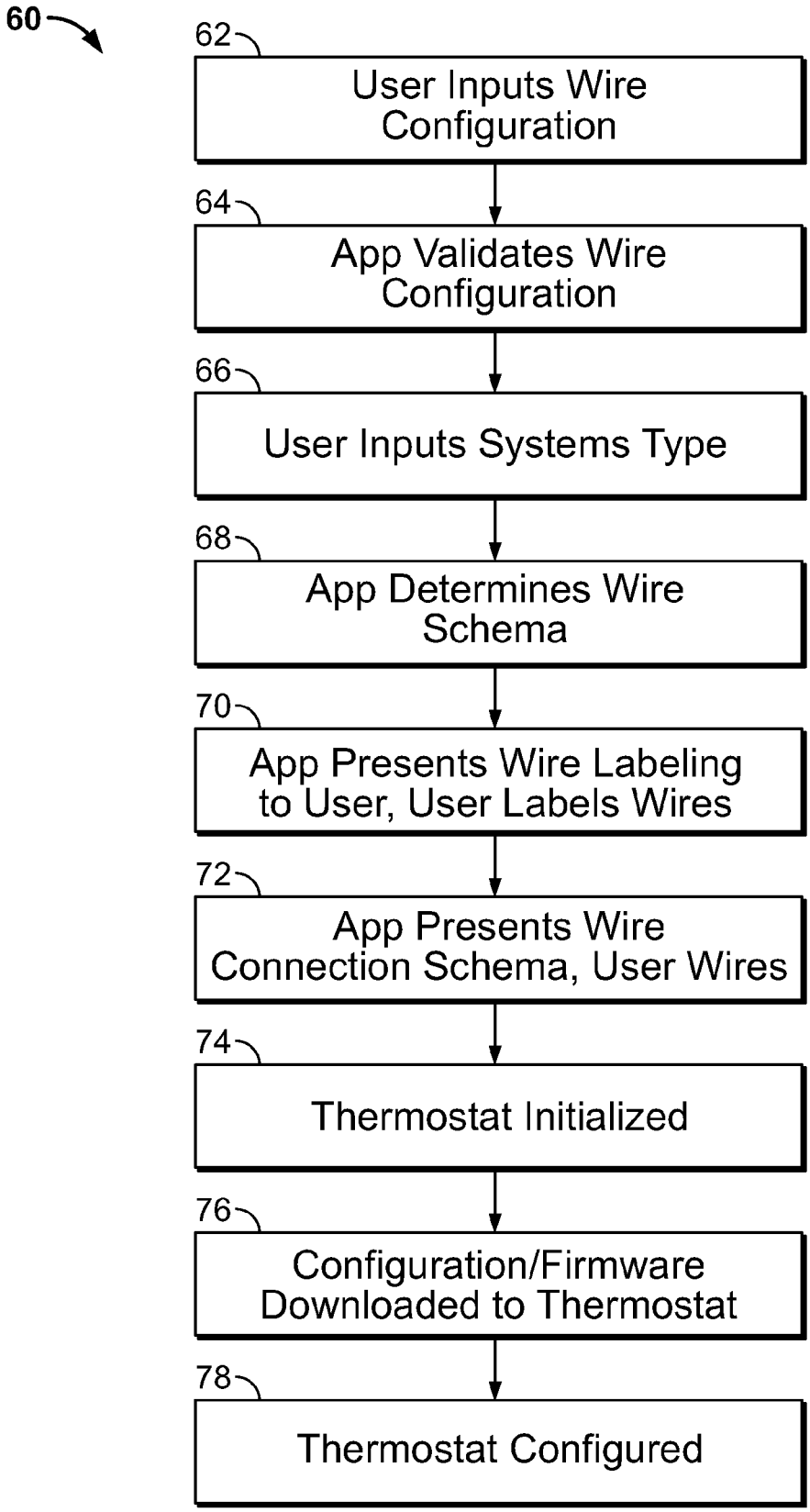
FIG. 2 is a flow diagram of a method of facilitating installation of a thermostat or other controller in accordance with an example embodiment.

A flow diagram of one exemplary embodiment of a method of facilitating installation of a controller such as a thermostat for use in a climate control system is indicated generally in FIG. 2 by reference number 60. The method 60 shall be described with reference to the example apparatus 20 of FIG. 1. The method 60 may be performed, e.g., by a user who is an owner or installer using the software application 50 on or otherwise available to the user communication device 44 to install the thermostat 24. In process 62, in response to a request by the application 50, the user provides, e.g., via the user communication device 44, a description of the existing climate control system wire configuration with which the thermostat 24 is to be connected. In process 64, the application 50 validates the wire configuration as described by the user. For example, in some embodiments the application 50 may analyze the user's wire configuration description in relation to one or more tables describing possible wire configurations, e.g., as further described below. In various embodiments, if the application 50 determines that the user described an invalid wire configuration, then the application 50 provides a message to the user, who in response may provide a revised description of the wiring configuration.

In some embodiments, based on the wire configuration entered by the user, in process 66 the application 50 requests and the user provides to the application 50 additional information descriptive of the type of climate control system for which the thermostat 24 is to be installed, e.g., whether the climate control system provides gas, electric, or boiler/radiant heating as a primary heat source. Using the input provided by the user as described above, in process 68 the application 50 determines a schema for connecting the existing climate control system wires with terminals of the new thermostat 24.

It should be noted that although the foregoing processes 62 through 68 are described sequentially, the processes 62 through 68 may be partially and/or entirely performed in various ways and various orders. The processes 62 through 68 may, e.g., be interleaved with one another, performed with reference to one another, etc. For example, as a user enters information as described in process 62 and (in some embodiments) process 66, the processes 64 and 68 may be at least partially performed, and/or at least partially repeated, so that the application 50 may gradually "learn" the user's climate control system configuration and how to match the existing climate control system wiring to new thermostat wiring.

In process 70, the application 50 provides the user with information for labeling the existing climate control system wiring. The user may label the wiring, e.g., by placing physical labels on the climate control system wires in accordance with the labeling information. In process 72, the application 50 provides the schema determined in process 68 to the user for connecting the existing climate control system wires with terminals of the new thermostat 24. The user may physically connect the wiring of the thermostat 24 with the existing climate control system wiring in accordance with the schema and labeling. In process 74, the thermostat 24 is initialized. For example, having received power, e.g., from one or more batteries, the thermostat 24 may begin communicating, e.g., as a soft access point (AP) with the user communication device 44. In process 76, the application 50 downloads to the thermostat 24, e.g., via the user communication device 44, configuration parameters whereby the thermostat 24 may be configured appropriately in relation to the climate control system configuration. In process 78, the thermostat 24 is configured in accordance with the downloaded configuration parameters and may also be configured, e.g., for wireless communication with the user's home network, as further described below. It should be noted generally that the application 50 may be stored on and/or performed by various devices in various ways, locations, and sequences. In one example embodiment a remote server, e.g., included in the computer(s) 40, may receive, via the user communication device 44, user input of wiring and/or configuration information. The remote server may execute the application 50 to determine, e.g., a thermostat configuration for the user's new thermostat 24. The server may execute the application 50 to connect the thermostat 24 with the user network 26, and the server may push, or the thermostat 24 may pull, the thermostat configuration to the thermostat 24. In another example embodiment all or part of the application 50, instead of being downloaded to the user communication device 44, is stored remotely and made available to the user communication device 44, e.g., via a browser of the user communication device 44.

Figure 3:
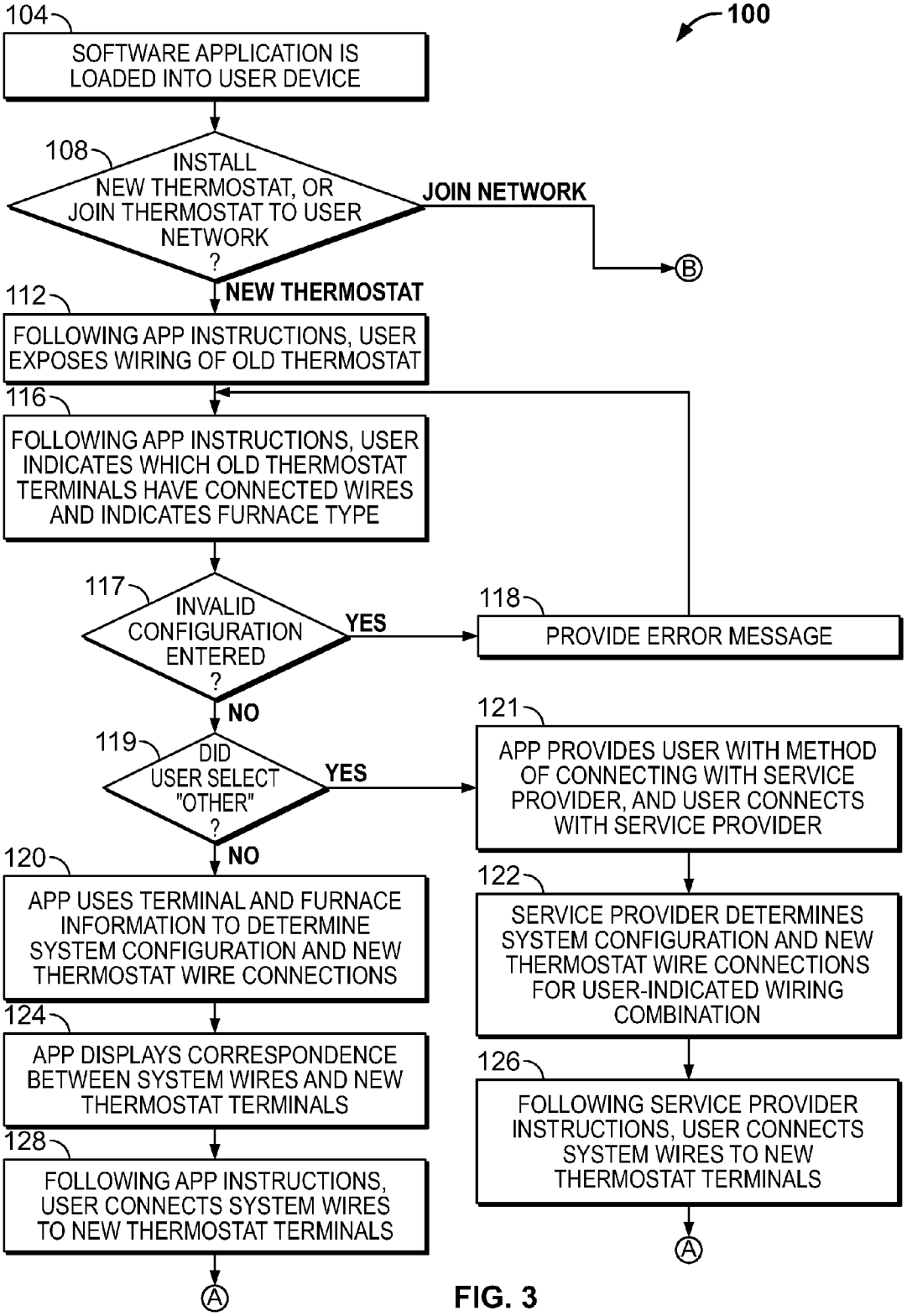
FIG. 3 is a flow diagram of a method of facilitating installation of a thermostat or other controller in accordance with an example embodiment.
Figure 3:
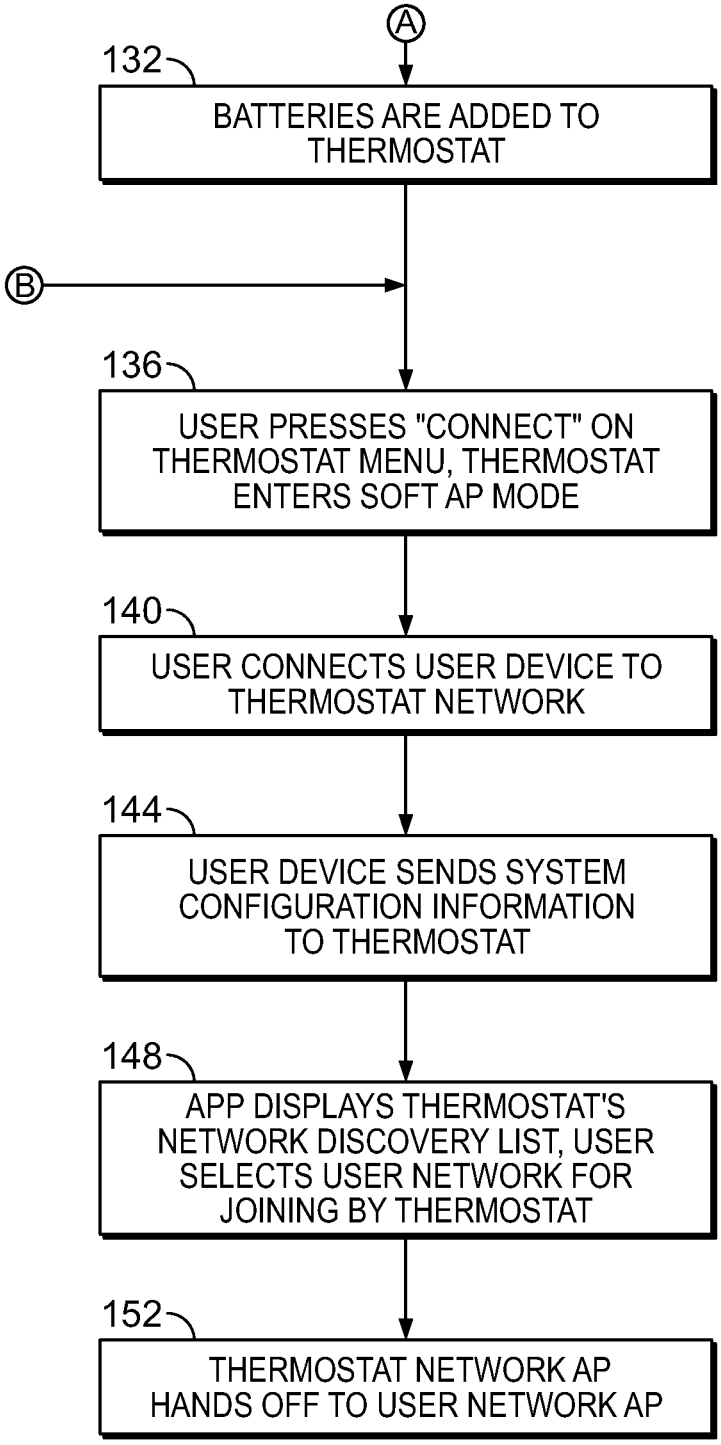

Another example embodiment of a method of facilitating installation of a controller such as a thermostat for use in a climate control system is indicated generally in FIG. 3 by reference number 100. The method 100 shall be described with reference to the example apparatus 20 of FIG. 1. In process 104, a user receives software 50 on a user communication device 44, which in the present example embodiment is a smart phone. The software 50 may be downloaded, e.g., to the user's smart phone 44 as a mobile application ("app"), e.g., from the computer(s) 40. In various embodiments, the user may communicate with an energy management services provider, e.g., via the web portal 42, to create and/or log into an energy management account associated with, e.g., the user, the thermostat 24, and/or the software application 50.

Figure 4:
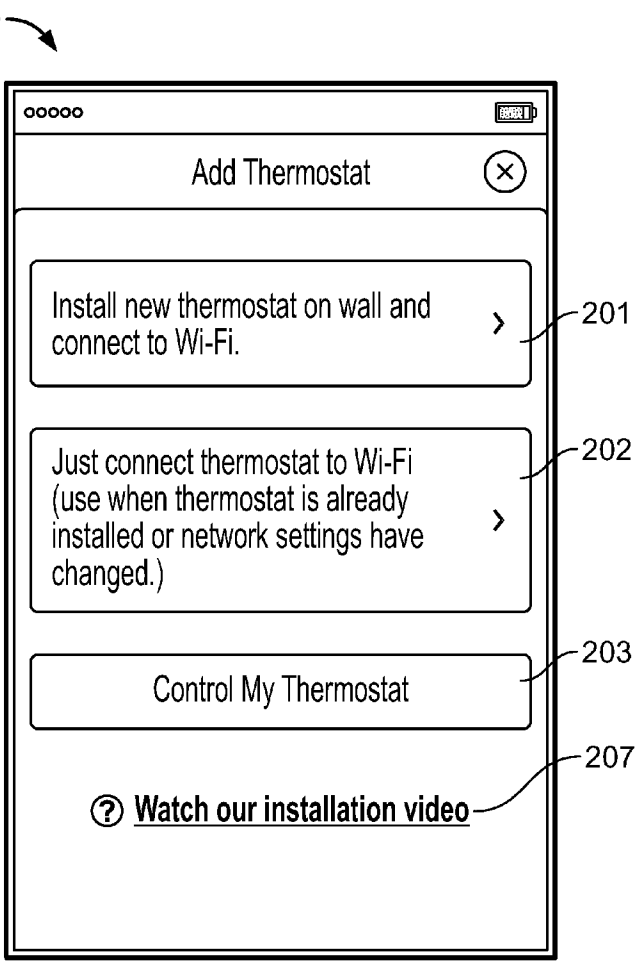
Figure 7:
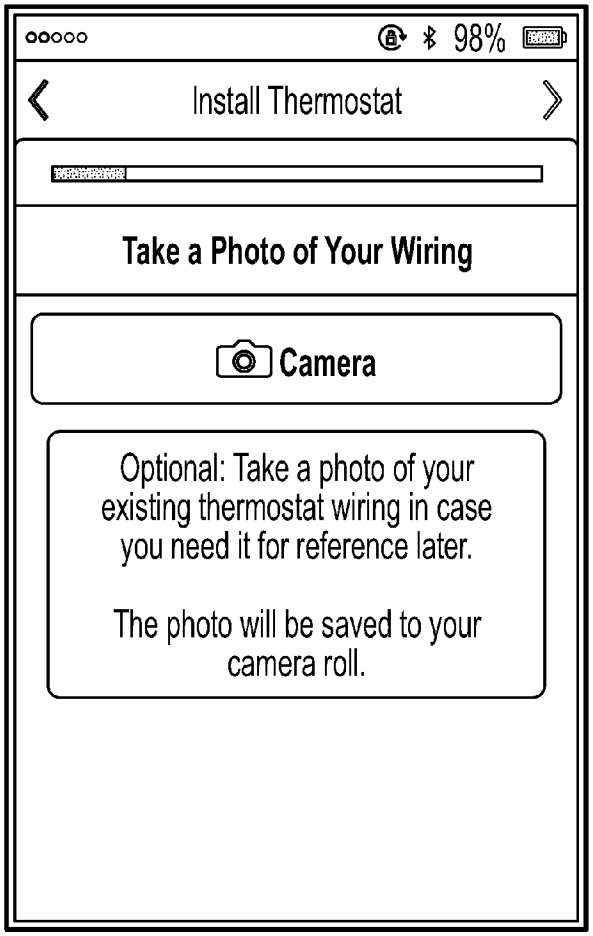
Figure 6:
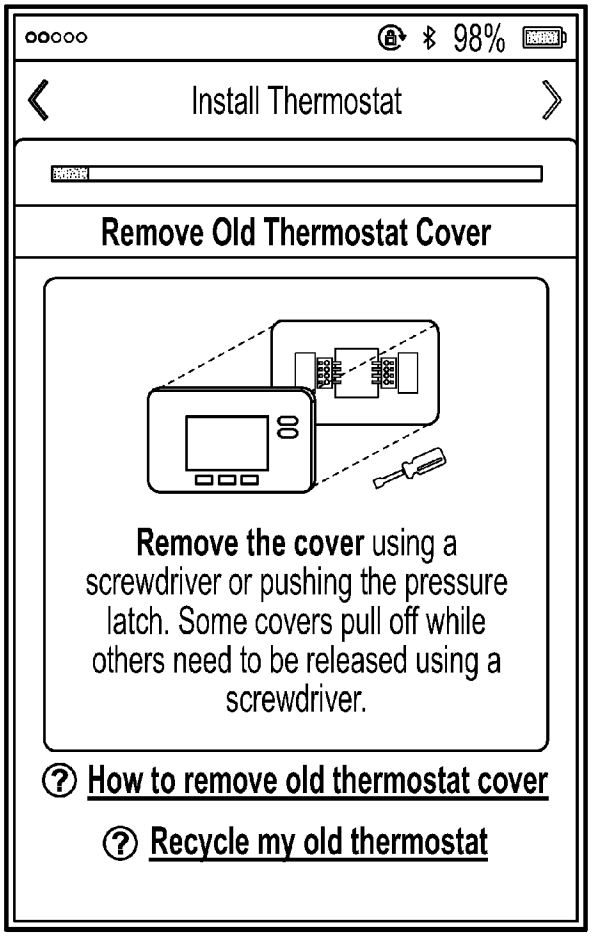
Figure 8:
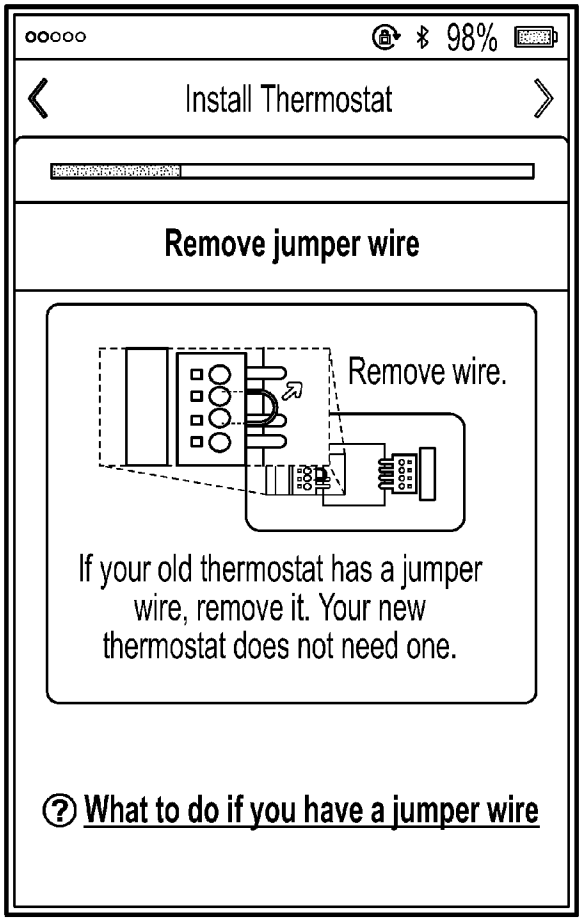

In the present example embodiment, the thermostat 24 is new and is to be installed as a replacement for an existing ("old") thermostat in the structure 28. In process 108, the application 50 queries the user, e.g., the homeowner, resident, or installer, as to whether the application 50 is to be used for facilitating installation of a new thermostat or for facilitating connection, e.g., in the user's home network, of a thermostat that is already installed. For example, as shown in FIG. 4, the application 50 may provide a touch-activated menu screen 200 on the smart phone 44. Since in the present embodiment the thermostat 24 is to be installed, the user touches a menu item "Install new thermostat" 201 on the screen 200. A menu item "Connect Thermostat to Wi-Fi" 202 may be activated if, e.g., the user wishes merely to connect a previously installed thermostat with the user's home network 26, e.g., as further described below. A "Control My Thermostat" menu item 203 allows the user to control the installed thermostat 24 through the application 50, which can include and/or have access to capabilities in addition to the capabilities described in the present disclosure. It should be noted that although various screens in the present example embodiment may be touch-activated, in various embodiments other or additional user interface types, e.g., a mouse, keyboard, joy stick, voice activation, etc. could be used in relation to various types of user communication devices.

Referring again to FIG. 3, in process 112 and, e.g., as shown in FIGS. 5-8, the application 50 provides instructions for the user to follow in order to expose the wire arrangement used to connect the existing thermostat in the climate control system, e.g., where the thermostat 24 is to be installed. For example, the user is instructed in a screen 204 to turn off power to the climate control system, and in a screen 206 to remove a cover of the existing thermostat. In a screen 208, the user is advised to take an optional photograph of the wiring of the existing thermostat. Such a photo could be useful, e.g., if the user makes a mistake. In a screen 210, the user is instructed to remove a jumper wire from the existing thermostat if a jumper wire is present.

Figure 5:
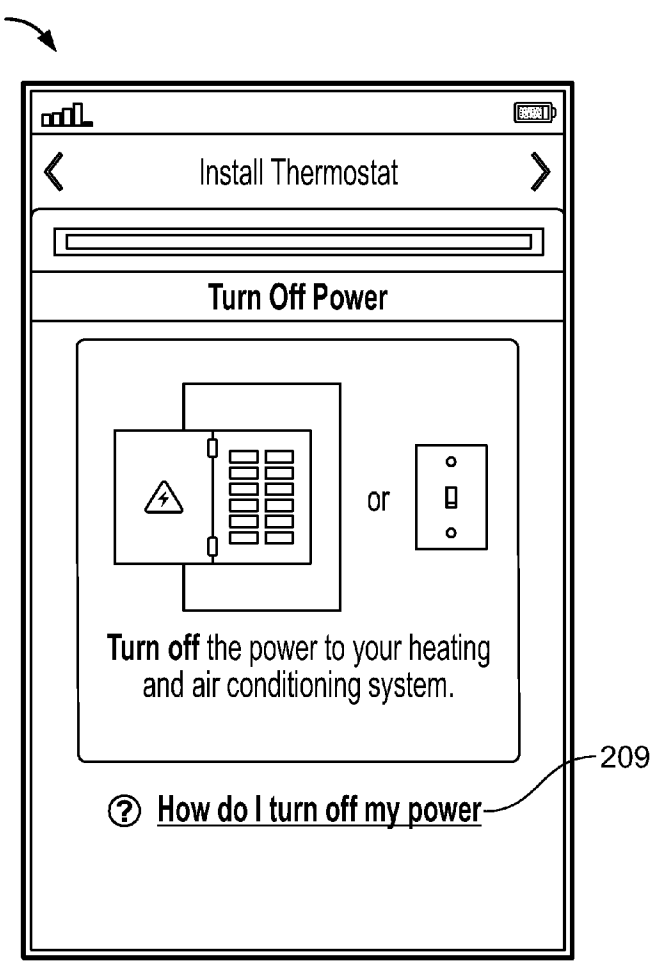
FIGS. 4-21 are example screenshots of graphical user interfaces on a smart phone in accordance with example embodiments.

It should be noted generally that in various embodiments, the application 50 may provide various pop-ups and/or links to videos, textual information, etc. via links on display screens, to provide further instructions to a user who may be installing and/or connecting a thermostat. For example, the screen 200 shown in FIG. 4 provides a link 207 whereby a user may watch an installation video, and the screen 204 shown in FIG. 5 provides a link 209 whereby a user may obtain information as to how to turn off power.

Figure 9:
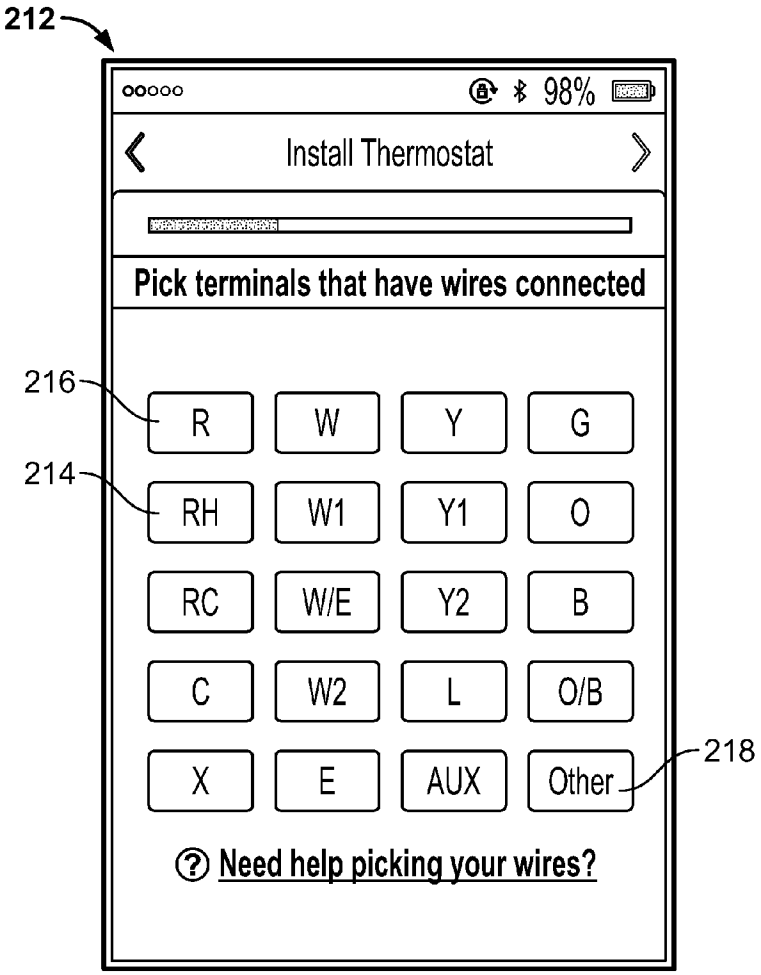

In process 116, the user is instructed to provide input to the application 50 describing wiring of the old thermostat and/or climate control system. For example, as shown in FIG. 9, the application 50 may display an example screen 212 including, e.g., a plurality of touch-activation areas 214 representing terminal labels 216 for wire types typically found in various climate control systems and to which various types of thermostats are commonly connectible. The user may selectively touch-activate the terminal labels 216 corresponding to wiring connections observed by the user between the climate control system and the old thermostat. In some embodiments, a user may activate an "Other" activation area 218 to indicate the presence of one or more wires not specifically identified by the terminal labels 216 on the screen 212. A user selection of the "Other" activation area 218 may be resolved as further discussed below.

It should be noted generally that the order of processes shown in FIG. 3 is illustrative only. For example, at least some processes included in the method 100 may be partially and/or entirely performed in various ways and various orders in various embodiments. Such processes and/or portions thereof, e.g., may be interleaved with one another, may be performed with reference to one another and/or using information determined in one another, etc. Thus in various embodiments, as a user incrementally enters information as requested by the application 50, the application 50 may "learn" as the user continues to enter information. In some embodiments the application 50 may e.g., incrementally determine the user's climate control configuration while incrementally validating the user's input, incrementally matching the existing climate control system wiring to new thermostat wiring, and/or incrementally determining an appropriate configuration for the thermostat 24.

Figure 10:
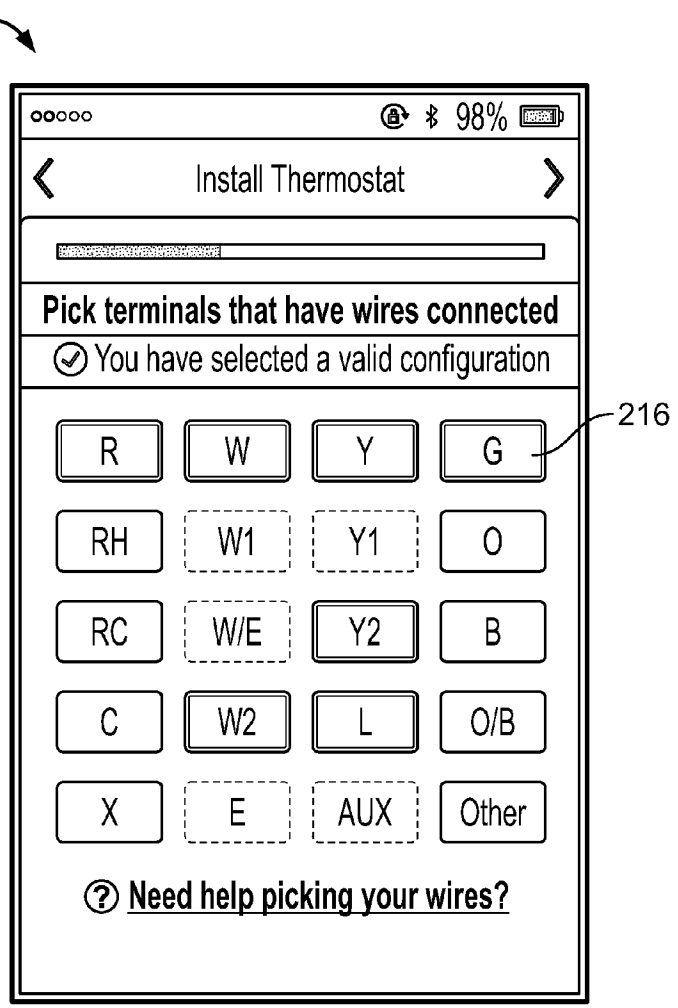

For example, in some embodiments and as shown, e.g., in FIG. 10, the application 50 may change the color of a user-selected terminal label 216 to a different color, to make it clear that the label has been selected. For example, the color of selected terminal labels 216 for "R", "W", "W2", "Y", "Y2", "L", and "G" has been changed from the color shown in FIG. 9. Additionally or alternatively, as the user makes selections from among the terminal labels 216, the application 50 may "gray out" or otherwise de-emphasize on the screen 212 any terminal labels 216 that the application 50 has determined are no longer possible choices in view of the user's previous selections. For example, as shown in FIG. 10, terminal labels 216 for "W1", "W/E", "E", "Y1" and "AUX" are no longer available for user selection. Thus, in various embodiments, display screens for selecting terminal labels 216 may become increasingly convenient for the user to read and to make selection therefrom as the process of selecting wire connections continues.

Figure 11:
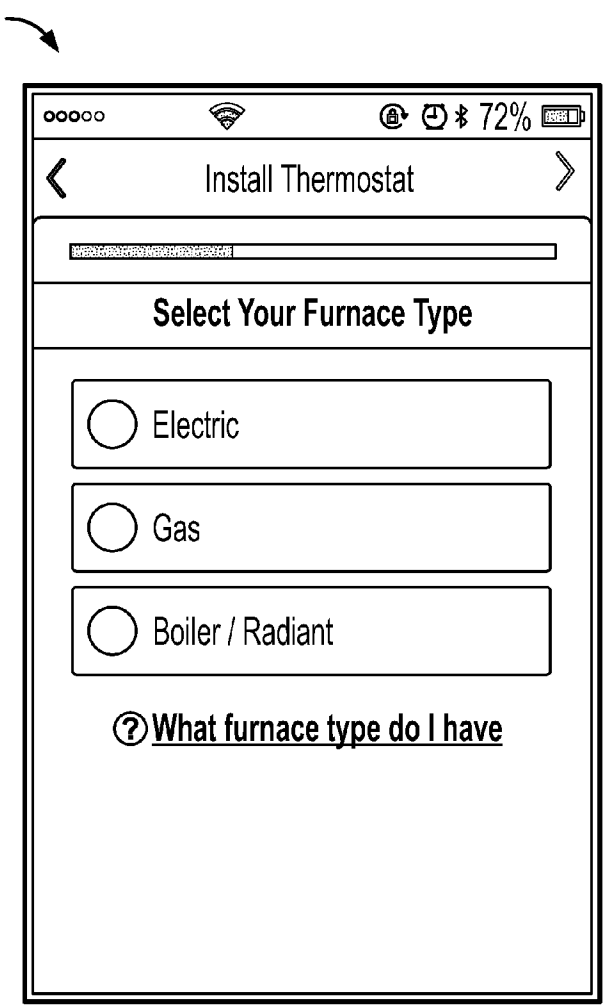

Based on the terminal labels 216 selected by the user via the screen 212, the application 50 may instruct the user to provide information identifying additional aspect(s) of the climate control system, e.g., a primary type of heating provided in the climate control system. For example, as shown in FIG. 11, the application 50 displays a screen 220 on which the user may indicate whether the climate control system provides gas, electric, or boiler/radiant heating. In various embodiments, the application 50 may use such information, e.g., to eliminate one or more climate control system configuration options, in order to determine an appropriate configuration for the thermostat 24 as further described below.

Figure 12:
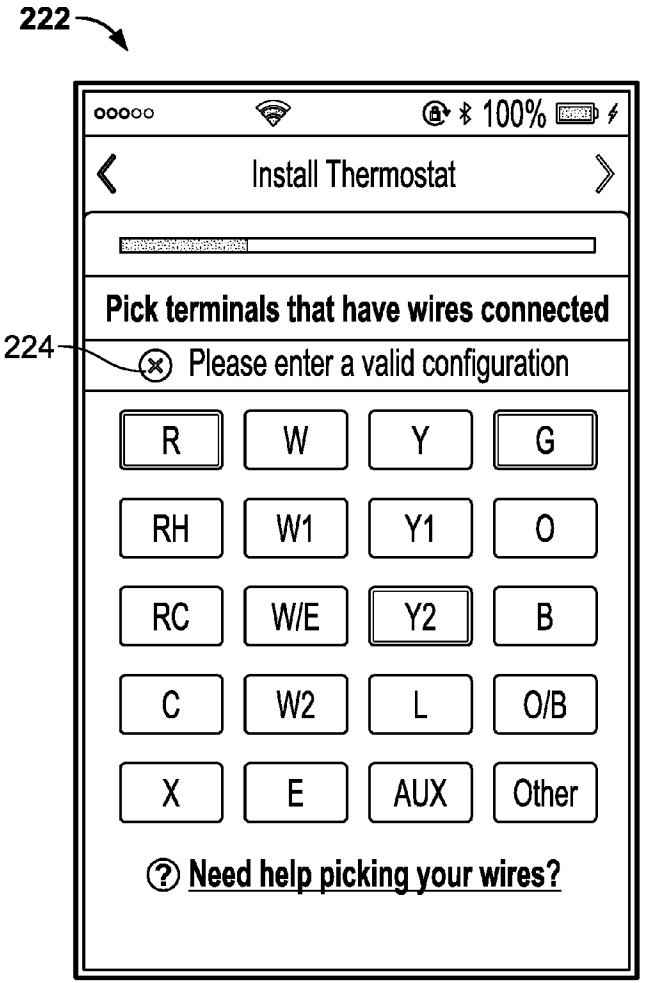

The application 50 analyzes the user's selections of terminal labels 216 to determine whether the selections describe a valid climate control system configuration. In various embodiments, the application 50 provides feedback to the user as to whether the user's selections, e.g., as entered on the screen 212 and/or screen 220, described a valid configuration. Referring again to FIG. 3 and in the present example embodiment, if in process 117 it is determined that the user entered an invalid wiring configuration, then in process 118 a message is displayed, e.g., as shown in FIG. 12. An exemplary screen 222 displays, e.g., a flag 224 indicating user entry of an invalid wiring configuration and requests the user to enter a valid configuration.

In various embodiments, the application 50 may validate a user-input wiring description based, e.g., at least in part on one or more tables. For example, Table 1 lists a plurality of example valid wire combinations that could be present in a climate control system.

TABLE 1

| Wires present | | Gas/Elec selection | Indoor Configuration | Indoor Stages | Outdoor Configuration | Outdoor Stages |
|---|---|---|---|---|---|---|
| R, RH, RC, C | W, Y, G | Gas | Gas | 1 | AC | 1 |
| R, RH, RC, C | W, Y, G | Elec | Elec | 1 | AC | 1 |
| R, RH, RC, C | W, W2, Y, G | Gas | Gas | 2 | AC | 1 |
| R, RH, RC, C | W, W2, Y, G | Elec | Elec | 2 | AC | 1 |
| R, RH, RC, C | W, Y, Y2, G | Gas | Gas | 1 | AC | 2 |
| R, RH, RC, C | W, Y, Y2, G | Elec | Elec | 1 | AC | 2 |
| R, RH, RC, C | W, W2, Y, Y2, G | Gas | Gas | 2 | AC | 2 |
| R, RH, RC, C | W, W2, Y, Y2, G | Elec | Elec | 2 | AC | 2 |
| R, RH, RC, C | W | Gas | Gas | 1 | AC | 0 |
| R, RH, RC, C | W | Elec | Elec | 1 | AC | 0 |
| R, RH, RC, C | W, G | Gas | Gas | 1 | AC | 0 |
| R, RH, RC, C | W, G | Elec | Elec | 1 | AC | 0 |

TABLE 1-continued

| Wires present | | | Gas/Elec selection | Indoor Configuration | Indoor Stages | Outdoor Configuration | Outdoor Stages |
|---|---|---|---|---|---|---|---|
| R, RH, RC, C | | W, W2 | Gas | Gas | 2 | AC | 0 |
| R, RH, RC, C | | W, W2 | Elec | Elec | 2 | AC | 0 |
| R, RH, RC, C | | W, W2, G | Gas | Gas | 2 | AC | 0 |
| R, RH, RC, C | | W, W2, G | Elec | Elec | 2 | AC | 0 |
| R, RH, RC, C | | W2, Y | Gas | Gas | 2 | AC | 1 |
| R, RH, RC, C | | W2, Y | Elec | Elec | 2 | AC | 1 |
| R, RH, RC, C | | Y, G | N/A | None | 0 | AC | 1 |
| R, RH, RC, C | | Y, Y2, G | N/A | None | 0 | AC | 2 |
| R, RH, RC, C | | G | N/A | None | 0 | None | 0 |
| R, RH, RC, C | O, B, O/B | Y, G | N/A | None | 0 | HP | 1 |
| R, RH, RC, C | O, B, O/B | Y, Y2, G | N/A | None | 0 | HP | 2 |
| R, RH, RC, C | O, B, O/B | W, Y, G | Elec | Elec | 1 | HP | 1 |
| R, RH, RC, C | O, B, O/B | W, W2, Y, G | Elec | Elec | 2 | HP | 1 |
| R, RH, RC, C | O, B, O/B | W, Y, Y2, G | Elec | Elec | 1 | HP | 2 |
| R, RH, RC, C | O, B, O/B | W, W2, Y, Y2, G | Elec | Elec | 2 | HP | 2 |
| R, RH, RC, C | O, B, O/B | W, Y, G | Gas | Gas | 1 | HP | 1 |
| R, RH, RC, C | O, B, O/B | W, W2, Y, G | Gas | Gas | 2 | HP | 1 |
| R, RH, RC, C | O, B, O/B | W, Y, Y2, G | Gas | Gas | 1 | HP | 2 |
| R, RH, RC, C | O, B, O/B | W, W2, Y, Y2, G | Gas | Gas | 2 | HP | 2 |

As can be seen from Table 1, a valid wire combination in and of itself may or may not be unique in relation to various climate control system configurations. For example, both the first and second rows of Table 1 list a combination of "R", "RH", "RC", "C", "W", "Y", and "G" wires. A gas or electric heating type listed in the first two rows of Table 1 makes each of the first two rows unique in Table 1. Thus in the present example embodiment, each row in Table 1 uniquely identifies a wire combination and (where applicable) a primary heating type. When the user has selected terminal labels 216 for a row of wires identified in Table 1 and, if requested by the application 50, the user also has selected a primary heating type (e.g., Gas, Electric (Elec), or Boiler/Radiant), e.g., on the screen 220, the application 50 may, e.g., compare the user input to rows of Table 1 to validate the user's selections. It should be noted, however, that Table 1 does not necessarily include all wiring combinations that might be valid in relation to a given thermostat and/or climate control system, and other or additional valid wiring combinations are possible. It also should be noted that in the present example embodiment, where a user has selected boiler/radiant heat as a primary heating type, the application 50 treats the selection in the same or a similar way as it would treat a user selection of gas as a primary heating type. Thus Table 1 also can be applicable in relation to various installations in structures in which boiler/radiant heat is the primary heat source.

As shown in Table 1, various climate control system configurations also may be characterized, e.g., by indoor configuration type, number of indoor stages, outdoor configuration type, and/or number of outdoor stages. In various embodiments, the application 50 may refer to table(s) in addition to or in place of Table 1 in determining an appropriate configuration for the thermostat 24. In various embodiments, various equipment configuration options for climate control systems may be provided, e.g., as shown in Table 2. It should be noted that Table 1 does not address geothermal configuration options as listed in Table 2. Thus in various embodiments, wiring for geothermal configuration options may be included in one or more tables other than or in addition to Table 1, and/or geothermal configuration options may be treated through user selection of the "Other" activation area 218 (shown in FIG. 9) as further discussed below. Table 2 is illustrative only, and other or additional configuration options may be available in relation to various climate control systems.

TABLE 2

| Outdoor Equipment Configuration Options: | | |
|---|---|---|
| 1 | Air Conditioner | 1-stage |
| 2 | Air Conditioner | 2-stage |
| 3 | Heat Pump | Air Source - 1-stage |
| 4 | Heat Pump | Air Source - 2-stage |
| 5 | Heat Pump | Geothermal - 1-stage |
| 6 | Heat Pump | Geothermal - 2-stage |
| 7 | None | |
| **Indoor Equipment Configuration Options:** | | |
| 1 | Air Handler | No Heat |
| 2 | Gas or Electric Heat | 1 stage |
| 3 | Gas or Electric Heat | 2 stage |
| 4 | Hot Water Boiler | 1 stage |
| 5 | Hot Water Boiler | 2 stage |

As another illustrative example, several example combinations of power wires, other wires and/or heat pump wires are shown in Table 3. The wire combinations, system types, and numbers of indoor and/or outdoor stages determine proper configurations for a thermostat and can determine, e.g., whether or not the thermostat needs to be configured to handle an auxiliary heating source.

TABLE 3

| Power Connections | Other Wires Present | Heat Pump wires | System Types | Indoor Stages Heat | Outdoor Stages Cool or Heat Pump | Translates to a configuration of: |
|---|---|---|---|---|---|---|
| R, RH, RC, C | W | | Conventional - Gas or Electric Heat | 1 | 0 | 1 heat - No cool |
| R, RH, RC, C | W, Y, G | | Conventional - Gas or Electric Heat | 1 | 1 | 1 heat - 1 cool |

TABLE 3-continued

| Power Connections | Other Wires Present | Heat Pump wires | System Types | Indoor Stages Heat | Outdoor Stages Cool or Heat Pump | Translates to a configuration of: |
|---|---|---|---|---|---|---|
| R, RH, RC, C | W, W2, Y, G | | Conventional - Gas or Electric Heat | 2 | 1 | 2 heat - 1 cool |
| R, RH, RC, C | W, W2, Y, Y2, G | | Conventional - Gas or Electric Heat | 2 | 2 | 2 heat - 2 cool |
| R, RH, RC, C | W, W2 | | Conventional - Gas or Electric Heat | 2 | 0 | 2 heat - No cool |
| R, RH, RC, C | Y, G | | Cooling Only | 0 | 1 | No heat - 1 cool |
| R, RH, RC, C | Y, Y2, G | | Cooling Only | 0 | 2 | No heat - 2 cool |
| R, RH, RC, C | Y, G | O, B, O/B | Heat Pump | 0 | 1 | 1 heat - 1 cool (no indoor auxiliary heat) |
| R, RH, RC, C | W, Y, G | O, B, O/B | Heat Pump | 1 | 1 | 2 heat - 1 cool (1 indoor auxiliary heat) |
| R, RH, RC, C | W, Y, Y2, G | O, B, O/B | Heat Pump | 1 | 2 | 3 heat - 2 cool (1 indoor auxiliary heat) |
| R, RH, RC, C | G | | Fan Only | 0 | 0 | No heat - No cool = Fan Only |

It should be noted that when the application 50 has determined wiring and climate control system configurations for the thermostat 24, the application 50 causes the configurations to be saved at least temporarily, e.g., on the smart phone 44, for subsequent transfer to the thermostat 24 as further described below. It also should be noted that other or additional tables, analyses, and/or sequences of analyses could be used in various embodiments to determine whether a user has identified wiring and/or other aspects of a climate control system accurately and sufficiently, so as to allow an application to accurately match existing climate control system wiring to new thermostat wiring and provide appropriate configuration parameters to a new thermostat.

Referring again to FIG. 3, in process 119 it is determined whether the user selected the "Other" activation area 218. If not, then in process 120 the application 50 uses the information input by the user to determine a schema for connecting wiring of the climate control system with the new thermostat 24. The wiring schema may be determined, e.g., using cross-reference information as shown in Table 4. In the present example, for each terminal label 216 displayed on the screen 212 that was selected by the user, the application 50 selects a corresponding (although not necessarily identically labeled) terminal of the new thermostat 24. In various embodiments the application 50 may prioritize the user-selected terminal labels 216, e.g., in order to group together inputs and outputs and to apply various rules for determining a wiring schema.

For example, where the user selects an "R" terminal label 216 on the screen 212, the application 50 determines that the "R" wire of the climate control system is to be connected with an "RH" terminal of the thermostat 24, unless the user also selects an "RH" terminal label 216. In such event the application 50 determines that the "R" wire of the climate control system is to be connected with an "RC" terminal of the thermostat 24 and the "RH" wire of the climate control system is to be connected with the "RH" terminal of the thermostat 24.

TABLE 4

| Terminal Labels Displayed Priority | Terminal labels displayed for user selection | Crosses to Thermostat Label and Color | Notes: |
|---|---|---|---|
| 1 | R | RH (red) | R crosses to RH unless RH and R are selected. If so, R crosses to RC. |
| 2 | RH | RH (red) | |
| 3 | RC | RC (red) | A minimum of 1 connection to RC or RH is made. A maximum of 2 connections cross to RC and RH. |
| 4 | C | C (blue) | if C is selected, do not allow X |
| | X | C (blue) | If X is selected, do not allow C |
| 5 | W | W/E (white) | Only one of W, W1, W/E, Aux, and E can be selected. |
| 6 | W1 | W/E (white) | |
| | W/E | W/E (white) | |
| | Aux | W/E (white) | |
| | E | W/E (white) | |
| 7 | W2 | W2 (brown) | When W2 is selected and O/B has a wire attached: If no W or W/E terminal is also selected, the old W2 = new "W/E" |
| 8 | Y | Y (yellow) | Only one of Y and Y1 can be selected. |
| 9 | Y1 | Y (yellow) | |
| | Y2 | Y2 (purple) | |

TABLE 4-continued

| Terminal Labels Displayed Priority | Terminal labels displayed for user selection | Crosses to Thermostat Label and Color | Notes: |
|---|---|---|---|
| 10 | O | O (orange) | Only one of O, O/B, and B can be selected, except: |
| 11 | O/B | O (orange) | 1: If user selects "O" and "B" then the "B" goes to "C" |
| | B | O/B (orange) | (as long as "C" or "X" was not selected.) |
| | | | 2: If user selects "O" and "B" and ("C" or "X"), the thermostat is not compatible. |
| 12 | G | G (green) | |
| | L | L (gray) | |

It should be noted that in various embodiments, more or fewer terminal labels 216 than as shown in the screen 212 may be displayed for user selection, and one or more tables may be structured accordingly for use in determining a wiring schema.

As previously mentioned, the user may select the "Other" activation area 218, e.g., if the user encounters a wire that is not represented by a terminal label 216. In the present example embodiment, selecting the "Other" activation area 218 causes the application 50 to provide to the user a way of connecting with a service provider, e.g., a technical expert or other appropriately knowledgeable person at a thermostat manufacturer, HVAC manufacturer, energy management services provider, installer, etc. In some embodiments the application 50 makes it possible for the user to communicate, e.g., through an Internet connection or other network connection, e.g., with a technical expert or other appropriately knowledgeable person. In various embodiments, a phone number may be listed whereby the user can confer with such a person. Communication between a user and a service provider could be accomplished through various means in order to determine a wiring arrangement appropriate to the user's existing wiring and new thermostat terminals. Except where otherwise indicated, the term "service provider" may be used herein and in the claims to refer to any one of various types of service providers, including but not limited to energy management services providers, climate control system contractors and/or installers, technicians, persons and/or companies who can provide information and/or services applicable to solving a climate-control-system-related issue or performing a climate-control-system-related task, etc.

Referring again to the present example embodiment shown in FIG. 3, it is determined in process 119 whether the user selected the "Other" activation area 218. If not, then the application 50 proceeds to perform process 120 as previously described. If the user selects "Other," then in process 121 a message may be displayed, e.g., as shown in Table 5. Additionally or alternatively, the user may be provided with a method of connecting with a service provider. When the user and service provider are connected, the user may describe the existing wiring arrangement he/she has encountered. The user and the service provider may confer, e.g., by talking and/or in writing, dependent on the connection medium or media, in order to determine a wiring arrangement appropriate for the user's new thermostat 24. In process 122, the service provider obtains from the user a description of the user's existing wiring arrangement and uses the wiring information to help the user determine a schema for connecting the existing system wiring and the new thermostat terminals, and in various embodiments, to determine parameters for configuring the thermostat 24. In process 126, the user may follow the service provider's instructions to connect the existing system wiring with terminals of the new thermostat 24.

In various embodiments, the service provider and/or the application 50 may retain wiring information and/or configuration information obtained in process 122. Such information, e.g., may be given to and used by a software programmer to update the application 50, e.g., by adding wiring configuration description(s) and/or wiring cross-reference(s) obtained, e.g., in process 122 to table(s) in which wiring configurations and/or cross references are described, e.g., in table(s) such as Table 1 and/or Table 4. In some embodiments, the application 50 may be configured and/or updated to display additional terminal label(s) 216 to make additional wire selection(s) available for user selection, e.g., on a screen such as the screen 212 and/or on additional screen(s). Additionally or alternatively, the application 50 may display informational messages to the user in response to user selections of various wires and/or selection of the "Other" activation area 218. A number of additional wires that might be encountered in climate control systems, and messages that may be displayed for such wires, are shown in Table 5. Various sequences of user selections, and displays in response to user selections, could be provided in various embodiments to provide cross-referencing or other treatment of additional wiring.

In some embodiments the application 50 may be configured to check a server and/or store, e.g., iTunes® store, Android™ store, etc. through which the application 50 may be made available, e.g., to HVAC installers and others who may use the application 50 on a repeated basis. In such manner, e.g., an installer of thermostats may be provided with new wiring configurations "learned" by the application 50, e.g., when the application 50 has been programmer-updated based on wiring and/or configuration information obtained from user(s) and/or service provider(s), e.g., through use of the "Other" activation area 218 as previously described.

TABLE 5

| User wire selections and associated system messages. | |
|---|---|
| Other | Before attempting to install, contact us with your old thermostat model number and let us know what terminal you had that was not on our list. Maybe we can help you finish the installation. |
| A1 | Do not connect this wire-Old thermostat was for commercial applications. |
| S, S1, S2 | Do not connect this wire to the new thermostat. The old thermostat had remote sensors. This Wi-Fi thermostat does not accept remote sensor wires. |
| H, HUM, HUM1 | Do not connect this wire to the new thermostat. Old thermostat had humidification. This Wi-Fi thermostat does not accept humidification. |

TABLE 5-continued

| User wire selections and associated system messages. | |
|---|---|
| H2, HUM2 | Do not connect this wire to the new thermostat. Old thermostat had humidification. This Wi-Fi thermostat does not accept humidification. |
| D, DH, DHUM, DEHUM | Do not connect this wire to the new thermostat. Old thermostat had humidification. This Wi-Fi thermostat doesn't accept humidification. |
| D2, DH2, DHUM2, DEHUM2 | Do not connect this wire to the new thermostat. Old thermostat had de-humidification. This Wi-Fi thermostat does not accept de-humidification. |

Figure 13:
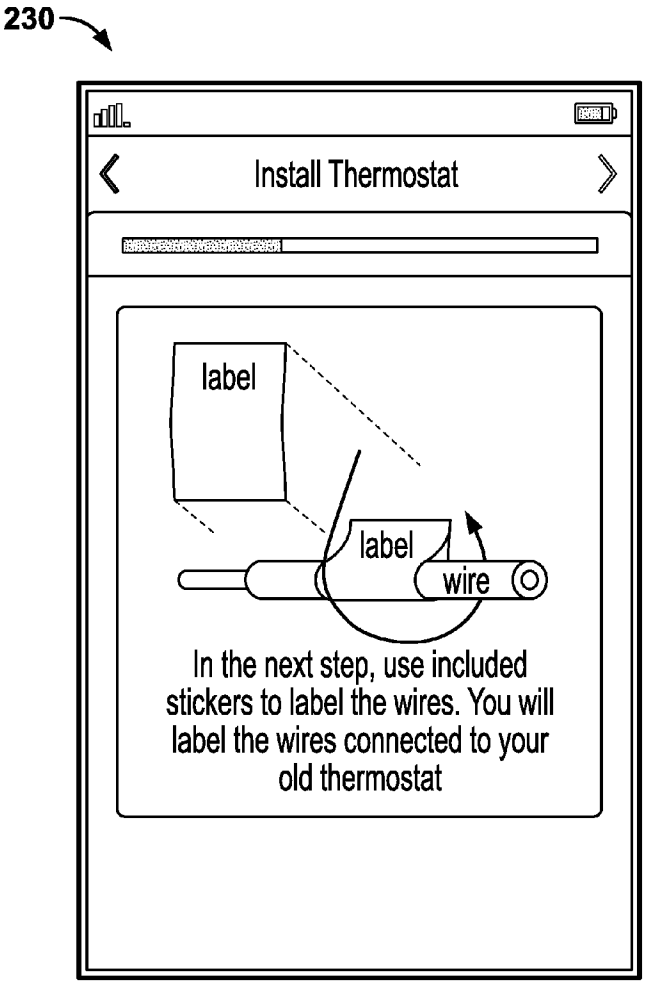
Figure 14:
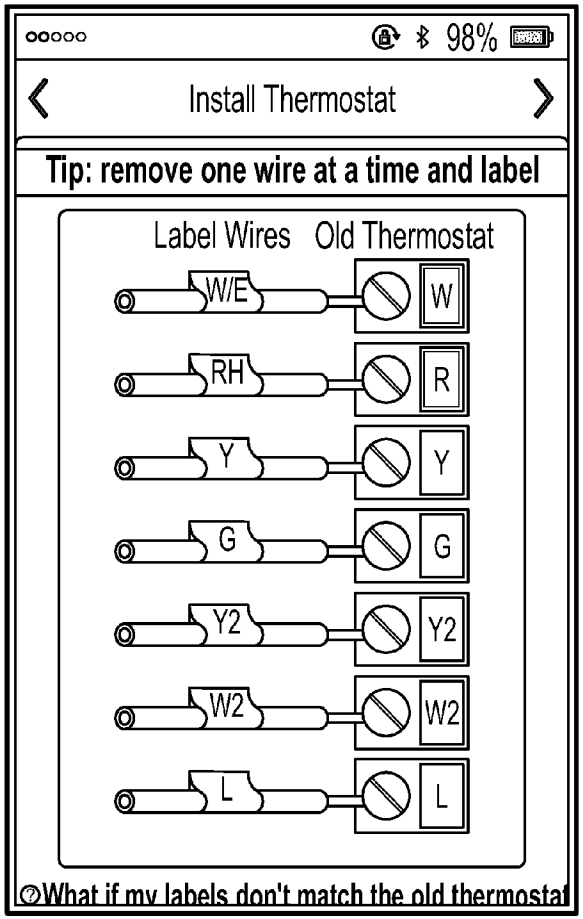

In process 124, the application 50 displays the correspondence between the climate control system wires and the terminals of the new thermostat 24. For example, the application 50 instructs the user how to cross-reference and label the wires connected to the existing ("old") thermostat to indicate where the wires are to be connected to the new thermostat 24. FIG. 13 illustrates an example screen 230 in which the user is instructed how to apply a label to a wire. FIG. 14 illustrates an example screen 232 showing the user how each wire connected to the old thermostat is to be labeled with a label applicable to wiring for the new thermostat 24. In some embodiments, a wire color may be selected, assigned, and/or displayed e.g., for an existing wire. Additionally or alternatively, numbers can be used instead of letters, e.g., to indicate terminal labels selected by the user. Selective use of color and/or numbering for wires, labels and/or terminals can increase clarity on display screens and can eliminate or reduce confusion. For example, where a user enters "RC" and "RH" to identify wired terminals, the application 50 may output "1" and "2" as labels for the "RC" and "RH" terminals.

Figure 15:
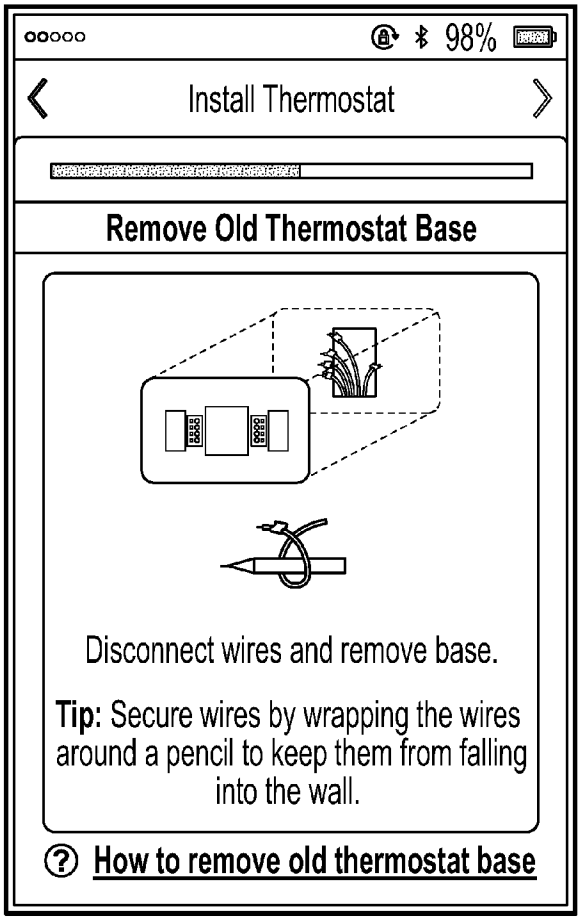
Figure 17:
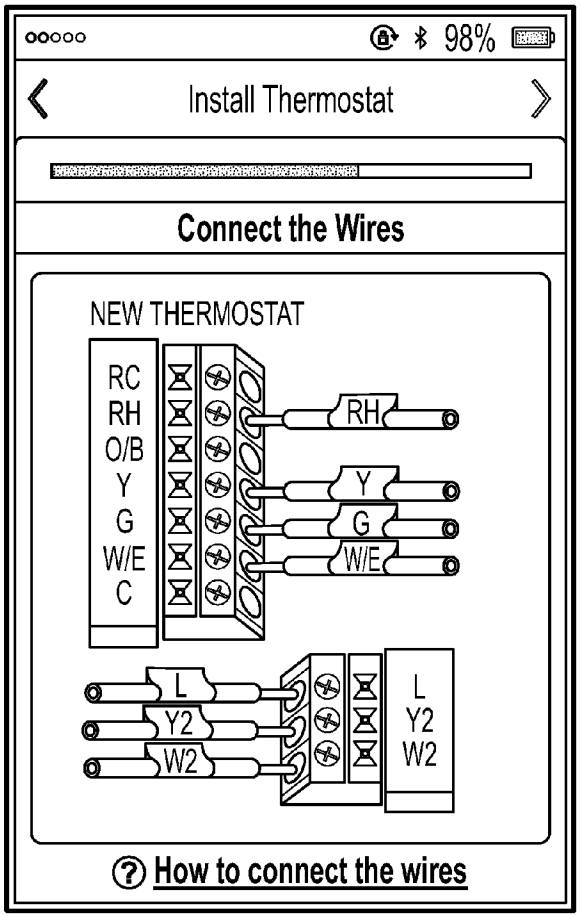
Figure 16:
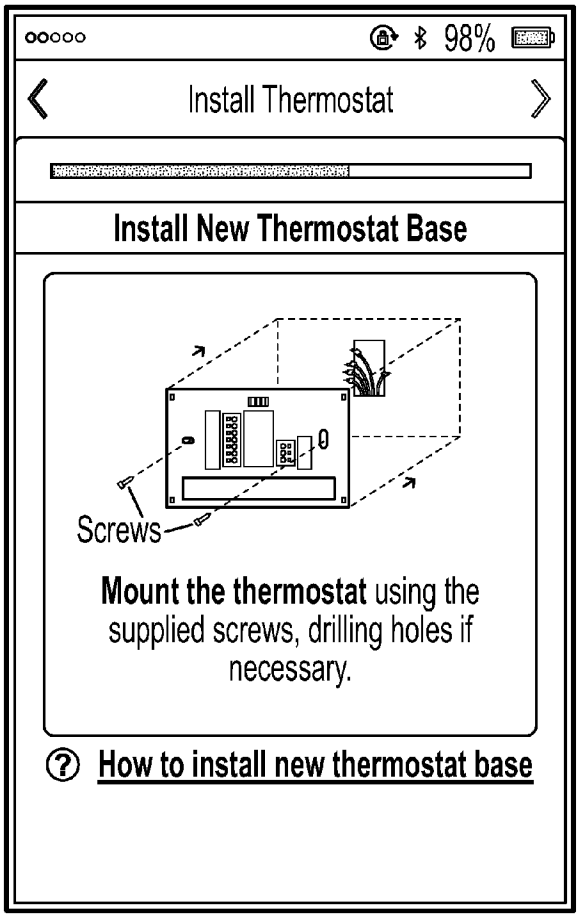
Figure 18:
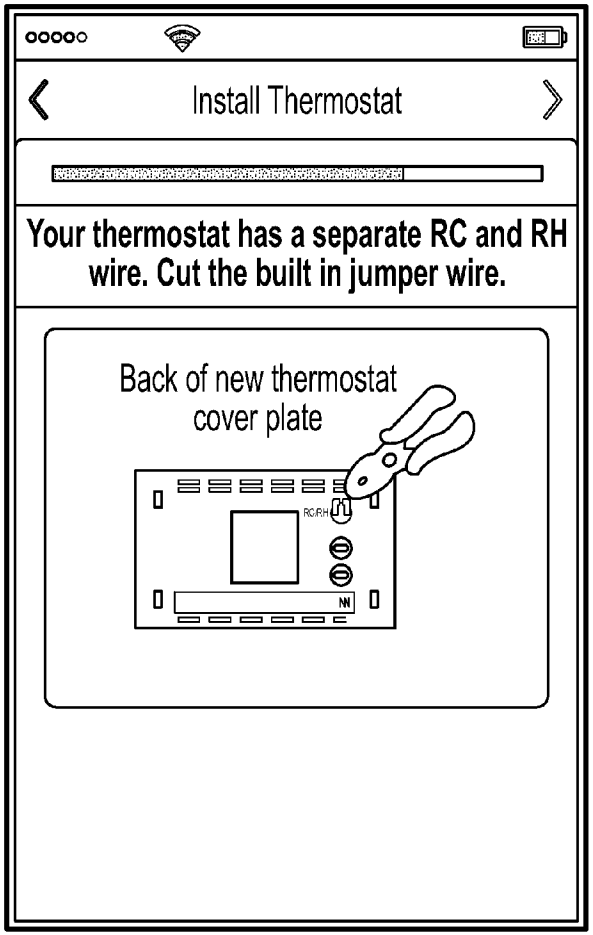

Referring again to FIG. 3, in process 128 the user, following instructions by the application 50, connects the new thermostat 24 with the climate control system wires. FIG. 15 illustrates an example screen 234 in which the user is instructed how to disconnect the old thermostat wiring and remove the old thermostat base, e.g., from a wall on which the old thermostat base is mounted. The user is advised to wrap the wires around a pencil to prevent them from falling into the wall. FIG. 16 illustrates an example screen 236 in which the user is instructed how to mount the new thermostat base, e.g., on the wall. FIG. 17 illustrates an example screen 238 showing how the labeled wires are to be inserted in the new thermostat terminals. FIG. 18 illustrates an example screen 240 in which the user is instructed to cut a built-in jumper wire to separate an "RC" wire from an "R" wire at the back of a cover plate of a thermostat that is to be connected to separate "R" and "RC" wires.

Figure 19:
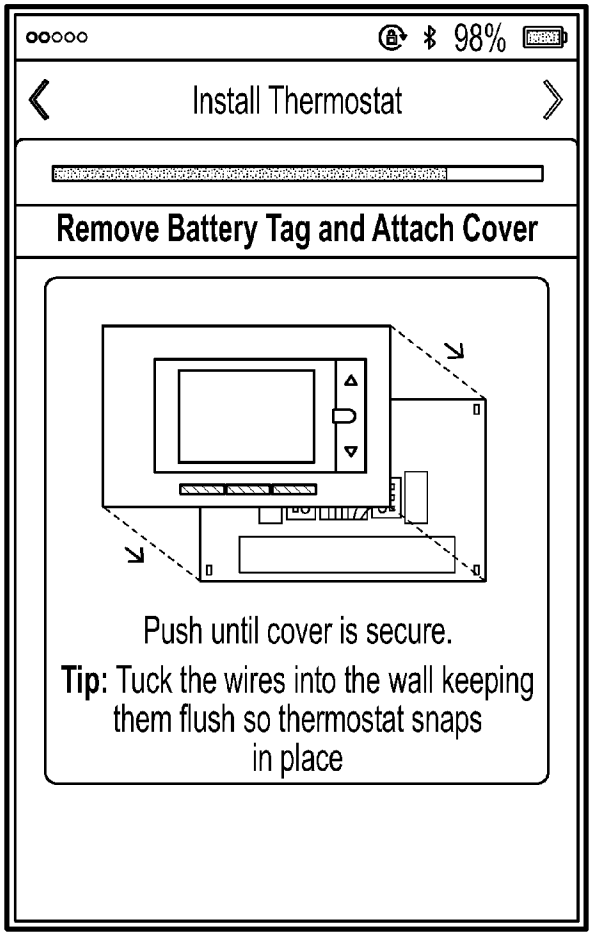

In process 132, the user may insert batteries into the new thermostat 24. FIG. 19 illustrates an example screen 242 instructing the user to insert batteries and to attach a cover to the thermostat 24. In the present embodiment when the thermostat 24 has been provided with battery power, the thermostat 24 is capable of communicating wirelessly. Additionally or alternatively, the thermostat 24 may be made capable of communicating wirelessly, e.g., when AC line power is provided to the thermostat.

Figure 20:
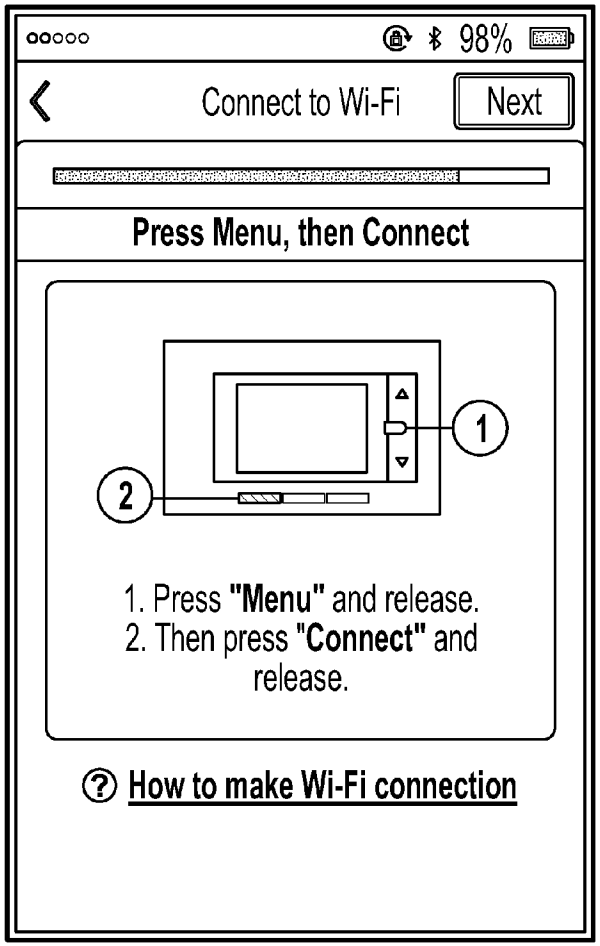

In process 136, the user may, e.g., activate a menu item on the thermostat 24 to initiate wireless network connectivity of the thermostat 24. Specifically, and for example, FIG. 20 illustrates an example screen 244 instructing the user how to activate a "Connect" button on the thermostat 24. When, e.g., a user has pressed "Menu" and subsequently pressed "Connect" in response to the screen 244, a wireless signal may start flashing on the thermostat 24. In the present example embodiment, when the user activates "Connect," the thermostat 24 is caused to enter a "soft AP" mode and begins advertising itself as a network access point, e.g., for its own wireless network.

Figure 21:
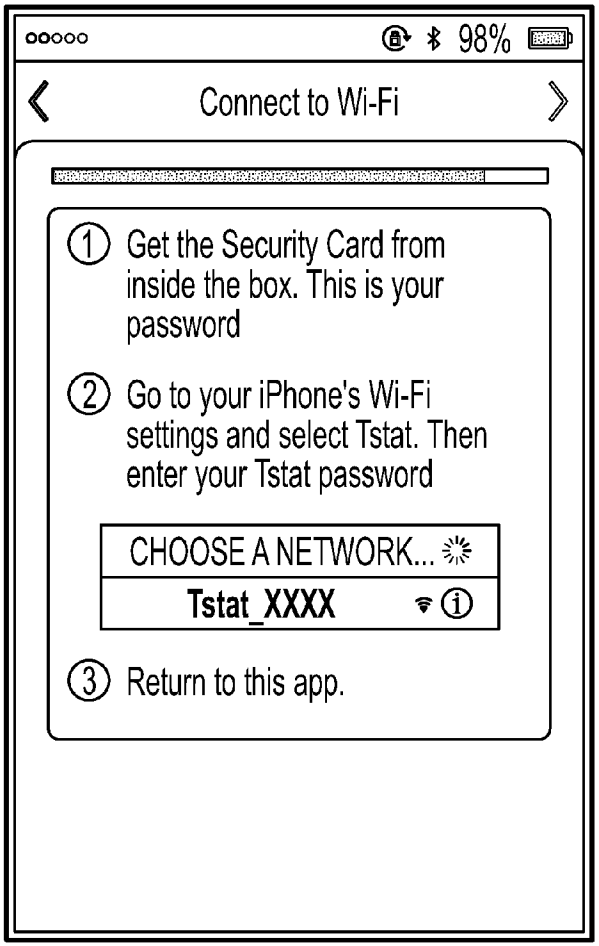

In process 140, the user connects the smart phone 44 to the wireless network of the thermostat 24. FIG. 21 illustrates an example screen 246 instructing the user how to make such a connection. In the present embodiment, the wireless network of the thermostat 24 is password-protected. Accordingly the user first is instructed to obtain the password, e.g., as may be printed on a card included in a box with the thermostat 24 at purchase. The user then may operate the smart phone 44 to cause the smart phone 44 to exit the application 50 and to display the phone's Wi-Fi settings, which, as known in the art, typically include a list of wireless networks within range of the smart phone 44. In various embodiments, the service set identifier (SSID) of the wireless network of the thermostat 24 appears in the list of networks. The user may select the network of the thermostat 24 and enter the network password, whereby the smart phone 44 may join the network of the thermostat 24. In the present example embodiment the user, having connected the smart phone 44 into the network of the thermostat 24, may invoke the application 50, e.g., by activating an icon for the application 50 displayed on the smart phone 44, to cause the smart phone 44 to re-enter the application 50.

In process 144, the application 50 automatically causes the user communication device 44 to send the previously saved wiring and configuration information for the climate control system to the thermostat 24 via the wireless network connection with the thermostat 24. In various embodiments, the thermostat 24 is thereby configured for the appropriate climate control system type. It should be noted that in various embodiments the application 50 could automatically cause the saved wiring and configuration information to be sent to the thermostat 24 any time after the user communication device 44 has joined the network of the thermostat 24 and before the thermostat 24 leaves the "soft AP" mode as further described below.

In various embodiments, a user may use the application 50 to set up additional features on the thermostat 24. For example, the user may select an "on" or "off" default for a backlight of the thermostat 24. Other or additional features may include, e.g., a language selection for a thermostat that provides a textual user interface, a temperature selection of Fahrenheit or Centigrade, etc. In some embodiments, the application 50 may automatically select, e.g., a default language, default temperature scale, etc., based on an address of the structure in which the thermostat 24 is installed. For example, where the structure is listed in the application 50 as being in Quebec, the French language and Centigrade temperature may be automatically selected.

In process 148, the thermostat 24, performing as a "soft" network access point in relation to the smart phone 44 and application 50, sends for display on the smart phone 44 a list of wireless networks within range of the thermostat 24. Where the list includes, e.g., the user's home network 26, the user may operate the smart phone 44 to select connection with his/her home wireless network 26. In process 152, the thermostat 24, performing in "soft AP" mode, "hands off" to the user's home network 26 access point and then drops out of "soft AP" mode. Thus, the thermostat 24 is joined to the user's home network 26 and may thereby access the Internet. It should be noted that the processes 136 through 152 are exemplary only, and that the thermostat 24 could be joined in a local network in other or additional ways. In some embodiments, when the installation has been completed, the user is instructed to restore power to the climate control system and is notified that the thermostat 24 is ready for use. In various embodiments and as further described below, the application 50 may provide screens by which a user registers the thermostat 24, e.g., to the user's user account, with the energy management services provider.

In various example embodiments, when a user has changed the settings on a home network, he/she may wish to use the application 50 to reconnect a previously installed thermostat with the home network. Thus, when the user is queried, e.g., as in process 108, as to how the application 50 is to be used, the user may activate, e.g., the "Connect Thermostat to Wi-Fi" menu item 202 as shown in FIG. 4, to transfer control, e.g., in execution of the application 50, to perform, e.g., as described with reference to processes 136-152 of FIG. 3.

The inventors have observed that when a climate control system needs servicing and/or maintenance, it would be convenient for the owner to be able to contact a service provider quickly and without confusion as to which service provider might be familiar with the owner's particular system. Accordingly, in some embodiments a software application is executable to provide information for contacting a service provider, e.g., that installed a thermostat and/or that could service a climate control system including a thermostat.

In one example embodiment, each of one or more climate control system service providers, e.g., who anticipate installing one or more thermostats, establishes a contractor account with the energy management services provider that operates the computer(s) 40 and the web portal 42. For example, a service provider establishes a contractor account on a contractor database server of the computer(s) 40 and provides identifying data for storage in a contractor database in relation to the contractor account. Such data may include, e.g., a contractor and/or company name, address, logo, and telephone number(s), which may include, e.g., an individual contractor's personal cell phone number. The contractor may provide such data to the computer(s) 40, e.g., via a secure connection to the computer(s) 40 and via the web portal 42. The connection may be, e.g., an https (secure hypertext transfer protocol secure) connection to a web page via a web browser.

An owner of the thermostat 24 and/or a contractor who, e.g., is to install the thermostat 24 may install the application 50 on the owner's smart phone 44 and activate the application 50 to aid, e.g., in installing and/or connecting the thermostat 24 for wireless communication. Additionally, in the present example embodiment, the software application 50 can provide, e.g., to the owner, information for contacting the contractor, e.g., in the event that the thermostat 24 and/or the owner's climate control system needs servicing.

Figure 22:
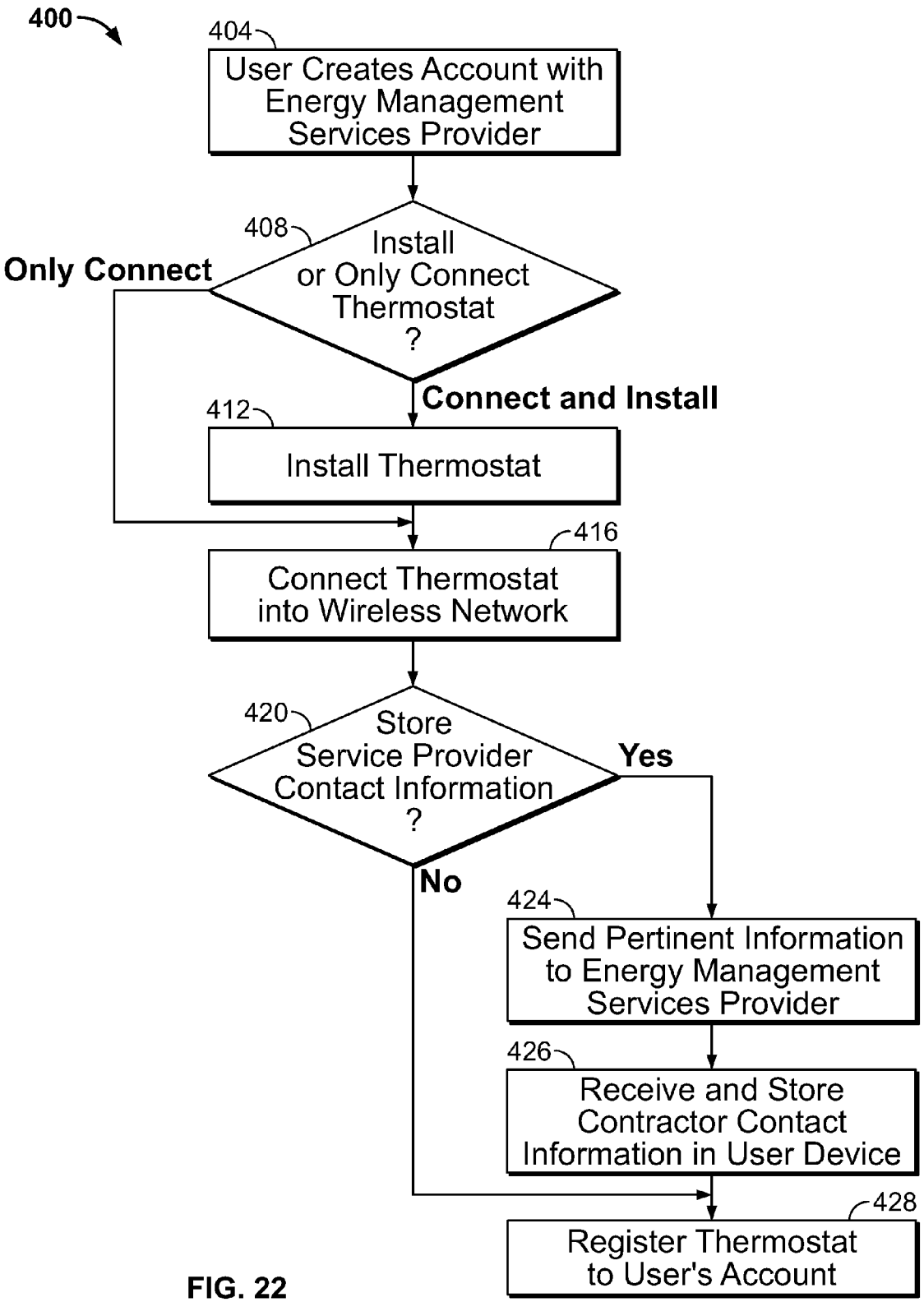
FIG. 22 is a flow diagram of a method of installing a thermostat or other controller in accordance with an example embodiment.
Figure 23:
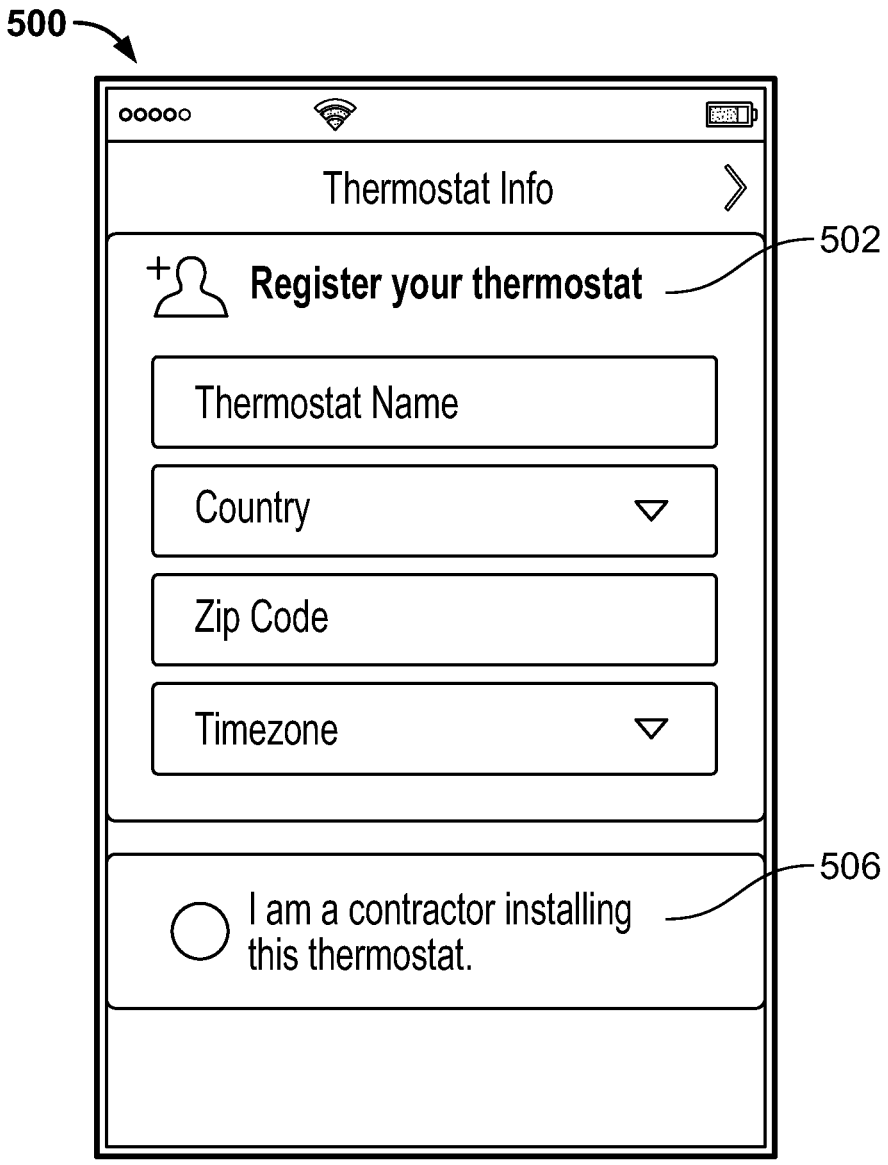
FIG. 23 is an example screenshot of a graphical user interface on a smart phone in accordance with an example embodiment.

One example method of provisioning a thermostat is indicated generally in FIG. 22 by reference number 400. In process 404, a thermostat owner uses the application 50 and a smart phone to create a user account with the energy management services provider, e.g., via the web portal 42 as previously discussed with reference to FIG. 3. In process 408, it is determined whether the thermostat 24 is to be installed and connected, e.g., with the owner's home network 26, or whether the thermostat 24 is already installed and merely needs to be connected with the home network 26. This determination may be made, e.g., in response to user input via a display screen, e.g., as previously discussed with reference to FIG. 4. If the thermostat 24 has been installed, e.g., as previously described and as indicated by a process 412 in FIG. 22, then in process 416 the application 50 may be executed to connect the thermostat 24 wirelessly with the home network 26, e.g., as previously described with reference to FIGS. 19-21. When, e.g., the thermostat 24 is connected with the Internet through the home network 26, the user may register the thermostat 24 with the energy management services provider via the web portal 42. For example, as shown in FIG. 23, an example screen 500 may be displayed that requests identifying information 502 for registration of the thermostat 24.

Referring again to FIG. 22, in process 420 it is determined whether to obtain information for contacting a service provider for servicing of the thermostat 24 and/or climate control system. For example, the example screen 500 also includes an activation area 506 whereby a user may indicate, e.g., that he/she is a contractor installing the thermostat 24. If, e.g., the user activates the activation area 506, then the user may be requested to send to the energy management services provider, via the smart phone 44 and application 50, information that is pertinent to identifying a service provider. In some embodiments, an activation area may be displayed on the smart phone 44 by which the user may enter, e.g., a phone number of the installing contractor, etc. Additionally or alternatively, information pertinent to identifying a service provider may include a postal zip code of the location of installation of the thermostat 24. In process 424 the contractor phone number and/or other pertinent information is sent to the energy management services provider. If, e.g., the phone number entered by the user does not match a phone number recognized by the apparatus 20, the apparatus 20 may display a message on the smart phone 44 indicating that the apparatus 20 does not recognize the contractor phone number and that the contractor should use the energy management services provider website to register as a service provider.

In process 426, one of the computer(s) 40, in response to receiving and recognizing the pertinent information from the smart phone 44, identifies a service provider and sends information for contacting the identified service provider to the smart phone 44, where the information is stored for possible future use. In the present example embodiment, in process 428 the thermostat 24 is registered with the owner's user account at the energy management services provider.

Figure 24:
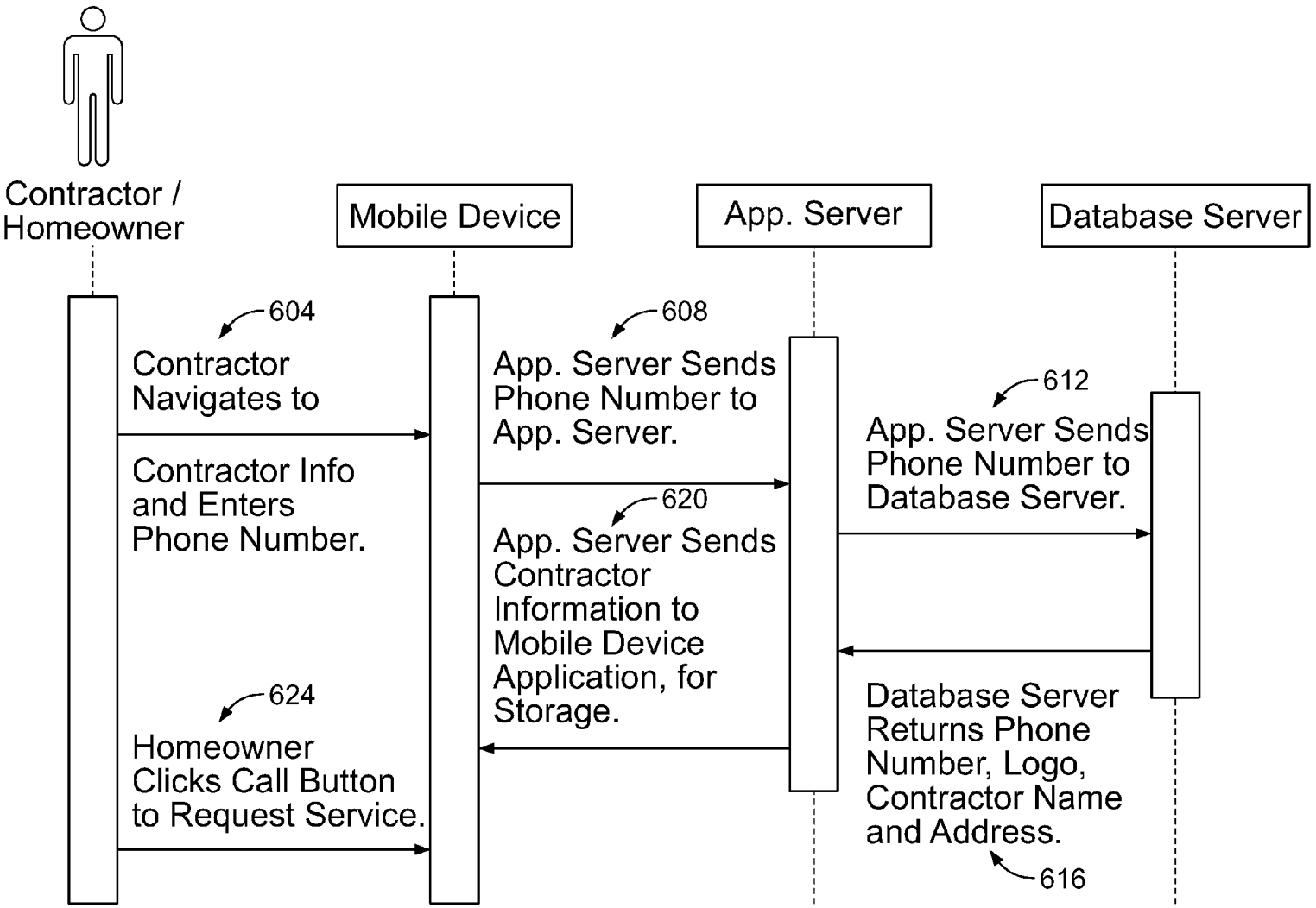
FIG. 24 is a diagram of a method of providing service provider information on a user communication device in accordance with an example embodiment.

The processes 424 and 426 are described in greater detail with reference to an example method indicated generally in FIG. 24 by reference number 600. In process 604, the user (e.g., contractor, homeowner, resident, etc. uses the smart phone 44, e.g., to navigate through screens provided by the application 50. For example, the user causes the smart phone 44 to display a screen, e.g., as shown in FIG. 23 that includes a request as to, e.g., whether the user is a contractor. Where the user indicates that he/she is a contractor, the user is requested to enter a contractor's phone number, e.g., as previously discussed. Additionally or alternatively, in some embodiments the user may be requested to enter a contractor phone number and/or a zip code of the thermostat location, regardless of whether or not the user indicates that he/she is a contractor. Other or additional information pertinent to identifying a service provider could be used in various embodiments to identify one or more service providers for a given thermostat or other controller.

In the present example embodiment, the user enters a contractor's phone number. In process 608, the application 50 sends the contractor's phone number from the smart phone 44, e.g., to a predetermined application server of the apparatus 20. The application server in process 612 sends the contractor's phone number, e.g., to a contractor database server of the computer(s) 40. In process 616, the contractor database server matches the contractor's phone number sent by the application server with a phone number stored in the computer(s) 40 database and thereby obtains information for the contractor stored in relation to the contractor's account with the energy management services provider, e.g., the contractor's phone number, name, address, and logo, which the database server sends to the application server. In some embodiments in which a zip code is sent as information pertinent to identifying a service provider, the contractor database server matches the zip code with contractors' zip codes and thereby may identify a contractor located in the same zip code and/or near the thermostat location.

Figure 25:
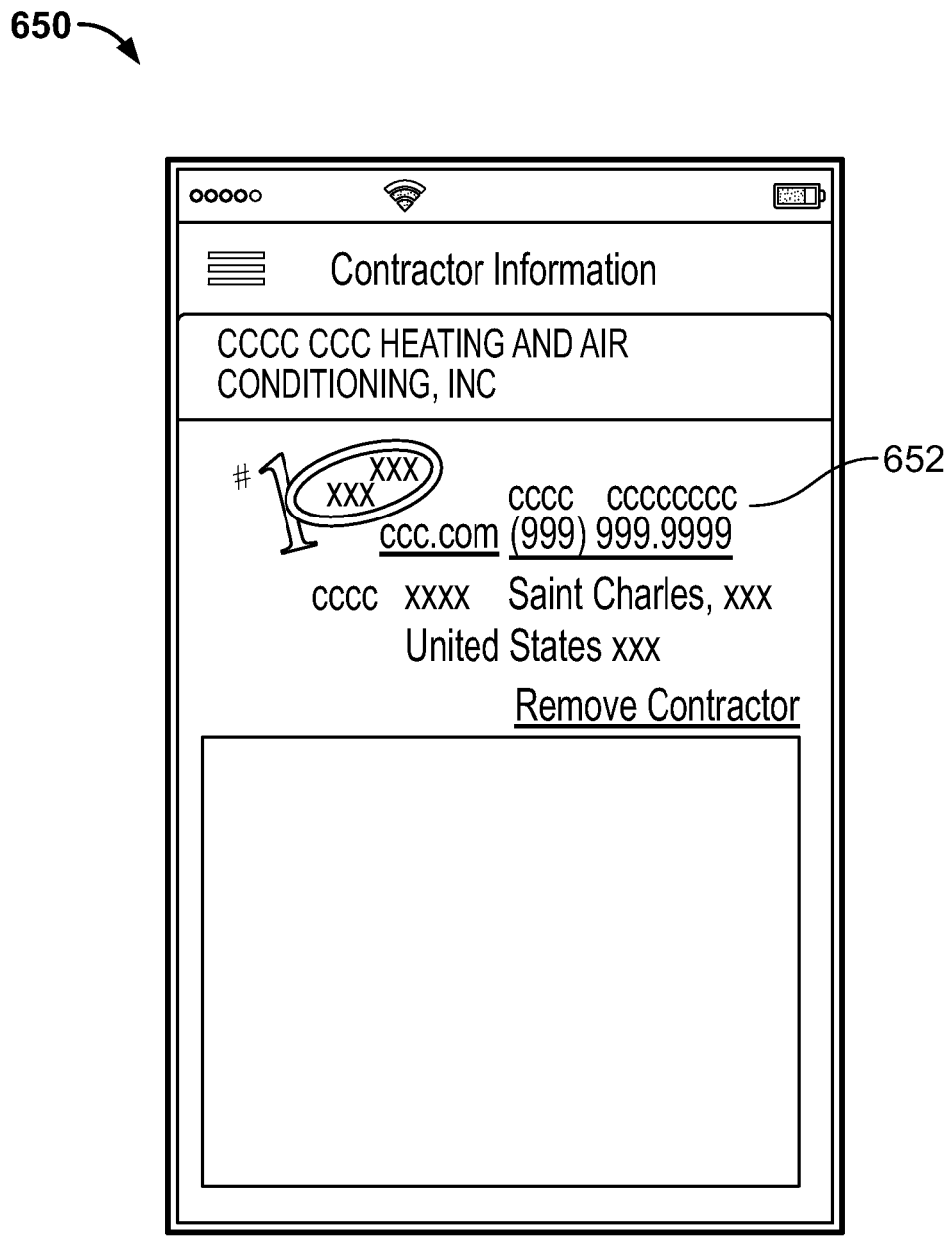
FIG. 25 is an example screenshot of a graphical user interface on a smart phone in accordance with an example embodiment.

In process 620, the application server sends the contractor contact information to the smart phone 44 and application 50. The contractor contact information is stored, e.g., for later display by the application 50 on the smart phone 44. After the information is stored, in process 624 the owner may, e.g., activate a "Contractor Info" menu item (not shown) provided by the application 50, to display the contractor's information on the smart phone 44. As shown in FIG. 25, the smart phone 44 may display, e.g., a screen 650 that includes information for reaching the contractor. The owner may, e.g., activate a call button or link 652 displayed on the smart phone 44 to call the contractor's phone number, so that the owner may request service by the contractor.

The application 50 provides the user with a plurality of capabilities for controlling settings and other features of the wirelessly connected thermostat 24 and for engaging in energy management, as may be provided via other or additional screens that may be displayed in various embodiments on the smart phone 44. The foregoing embodiments can make it easy, e.g., for a homeowner, resident, or contractor to obtain and store service provider information on a smart phone, so that the homeowner or other user can simply pull up a display of the service provider information and use it to contact the service provider.

Embodiments of the foregoing apparatus and methods make it possible to provide proper and safe installation steps for installing a thermostat or other controller. Such embodiments typically are easier to use and more accurate than other installation systems currently in use. Currently used systems often make available to installers printed information attempting to cover a wide range of systems, wiring diagrams and configuration options. Installers commonly suffer from information overload, which may lead to incorrect wiring, incorrect configuration, damaged equipment or property, returned products, additional service calls, and/or costly utility bills. In contrast, embodiments of the foregoing apparatus and methods can eliminate information overload for an installer and require no special training. Information relevant to a particular task at hand is presented, instead of information for substantially all possible systems and configurations. In various embodiments, it can be assured that a thermostat is configured correctly. There are no requirements for learning advanced thermostat and climate control system details. If a user can download an app, the user can be enabled to install a thermostat correctly.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus for facilitating installation and/or connection of a controller in a climate control system, the apparatus comprising:

a communication device having a processor and memory configured to execute instructions to:

receive user input describing a type of the climate control system and a pre-existing wire arrangement located where the controller is to be installed for use in the climate control system;

cross-reference wires of the pre-existing wire arrangement relative to terminals of the controller; and based on the user input and the cross-referencing, identify a configuration of the climate control system and specify wiring connections between the pre-existing wire arrangement and the controller.

2. The apparatus of claim 1, wherein the communication device is further configured to:

determine whether the user input describes a valid wire arrangement; and based on the determining and before the specifying of wiring connections, notify the user to change the user input.

3. The apparatus of claim 1, wherein the user input describing a type of the climate control system comprises a description of an aspect of the climate control system that, together with the wire arrangement, uniquely identifies the configuration of the climate control system.

4. The apparatus of claim 3, wherein the aspect of the climate control system comprises a primary heating type.

5. The apparatus of claim 1, wherein the wire arrangement comprises wiring connections between a previously installed controller and the climate control system.

6. The apparatus of claim 1, wherein:

the controller is at least temporarily capable of communicating with the communication device; and the communication device is further configured to execute instructions to transmit the identified configuration of the climate control system to the controller.

7. The apparatus of claim 1, wherein:

the controller is at least temporarily capable of communicating with the communication device; and the communication device is further configured to execute instructions to connect the controller with a wireless network.

8. The apparatus of claim 1, wherein the communication device is further configured to instruct a user how to make the specified wire connections.

9. The apparatus of claim 1, wherein:

the communication device comprises a user interface; and the processor and memory are further configured to display one or more images via the user interface, the one or more images providing instructions to the user in relation to installing and/or connecting the controller.

10. The apparatus of claim 9, wherein the one or more images comprise one or more images of the specified wiring connections between the wire arrangement and the controller.

11. A system-performed method of facilitating installation and/or connection of a controller in a climate control system, the method comprising:

providing computer-executable instructions to a communication device, the communication device having a processor and memory, the providing performed to configure the communication device to:

receive user input describing a type of the climate control system and a pre-existing wire arrangement located where the controller is to be installed for use in the climate control system;

cross-reference wires of the pre-existing wire arrangement relative to terminals of the controller; and based on the user input and the cross-referencing, identify a configuration of the climate control system and specify wiring connections between the pre-existing wire arrangement and the controller.

12. The method of claim 11, performed to configure the communication device to wirelessly transmit the identified configuration of the climate control system to the controller.

13. The method of claim 11, wherein:

the communication device includes a user interface; and the method further comprises providing computer-executable instructions to the communication device for displaying one or more images via the user interface, the one or more images providing instructions to the user in relation to installing and/or connecting the controller.

14. The method of claim 13, wherein the one or more images include one or more images of the specified wiring connections between the wire arrangement and the controller.

15. A method of facilitating installation and/or connection of a controller in a climate control system, the method performed by a communication device, the method comprising:

instructing a user how to expose a wire arrangement where the controller is to be installed for use in the climate control system;

receiving user input indicating how the wire arrangement is connected with an existing controller, the user input further indicating a type of the climate control system;

based on the user input:

cross-referencing terminals of the existing controller to terminals of the controller to be installed; and based on the cross-referencing, determining a configuration of the climate control system and how to connect the wire arrangement with the controller to be installed; and based on the determining, connecting with and configuring the controller for the determined configuration of the climate control system.

16. The method of claim 15, further comprising instructing the user as to how to connect the wire arrangement with the controller to be installed.

17. The method of claim 16, wherein instructing the user comprises providing one or more images on a user interface of the communication device.

18. The method of claim 15, further comprising connecting a wireless communication system of the controller to a local network.

19. The method of claim 15, wherein the controller includes a thermostat and the communication device includes one or more of the following: a smart phone, a tablet, a laptop, and a computer.

20. The method of claim 15, wherein the user is provided with a method of connecting with a service provider in response to user input to the communication device.

21. The method of claim 15, wherein a wiring arrangement is determined, based on user communication with a service provider, for a wiring combination other than a wiring arrangement predetermined for user selection.

22. The method of claim 15, wherein a wiring combination determined through user communication with a service provider is added as one of a plurality of wiring arrangements predetermined for selection as user input.

* * * * *